US011867033B2

(12) United States Patent
Alkhalidi

(10) Patent No.: US 11,867,033 B2
(45) Date of Patent: Jan. 9, 2024

(54) CASING DEPLOYED WELL COMPLETION SYSTEMS AND METHODS

(71) Applicant: Mousa D. Alkhalidi, Houston, TX (US)

(72) Inventor: Mousa D. Alkhalidi, Houston, TX (US)

(73) Assignee: Mousa D. Alkhalidi, Houston, TX (US)

( * ) Notice: Subject to any disclaimer, the term of this patent is extended or adjusted under 35 U.S.C. 154(b) by 38 days.

(21) Appl. No.: 17/463,080

(22) Filed: Aug. 31, 2021

(65) Prior Publication Data

US 2022/0065079 A1 Mar. 3, 2022

Related U.S. Application Data

(63) Continuation-in-part of application No. 17/009,559, filed on Sep. 1, 2020, now abandoned.

(51) Int. Cl.
*E21B 43/119* (2006.01)
*E21B 33/10* (2006.01)
*E21B 43/26* (2006.01)

(52) U.S. Cl.
CPC ..... *E21B 43/119* (2013.01); *E21B 33/10* (2013.01); *E21B 43/2607* (2020.05)

(58) Field of Classification Search
CPC .... E21B 2200/05; E21B 33/10; E21B 34/066; E21B 43/119; E21B 43/2607; E21B 43/261
See application file for complete search history.

(56) References Cited

U.S. PATENT DOCUMENTS 5,467,823 A 11/1995 Babour et al.
5,632,348 A 5/1997 Yunan
5,660,232 A * 8/1997 Reinhardt ..... E21B 43/116 166/317

(Continued)

FOREIGN PATENT DOCUMENTS

CA 2867207 A1 12/2014
CA 2879044 A1 3/2015

(Continued)

OTHER PUBLICATIONS

Office Action dated Oct. 5, 2021, for U.S. Appl. No. 17/009,559 (17 pg).

(Continued)

*Primary Examiner* — Daniel P Stephenson
(74) *Attorney, Agent, or Firm* — Conley Rose, P.C.

(57) ABSTRACT

A system for completing a wellbore extending through a subterranean earthen formation includes a casing string positioned in a wellbore extending through a subterranean earthen formation, a first perforating assembly coupled to the casing string, wherein the first perforating assembly includes a first perforation charge coupled to the casing string, wherein the perforation charge includes an explosive material configured to blast towards the earthen formation upon detonation of the first perforation charge, and a first sealing device coupled to the casing string, wherein the first sealing device includes a closed position configured to restrict fluid flow across the first sealing device when in the closed position.

23 Claims, 15 Drawing Sheets

(56) References Cited

U.S. PATENT DOCUMENTS

| | | | | |
|---|---|---|---|---|
| 6,009,947 | A * | 1/2000 | Wilson | E21B 43/11 166/299 |
| 6,386,288 | B1 | 5/2002 | Snider et al. | |
| 6,536,524 | B1 * | 3/2003 | Snider | E21B 34/14 166/373 |
| 6,962,202 | B2 | 11/2005 | Bell et al. | |
| 7,152,676 | B2 * | 12/2006 | Vella | E21B 33/14 166/250.14 |
| 7,273,102 | B2 | 9/2007 | Sheffield | |
| 7,963,342 | B2 | 6/2011 | George | |
| 8,151,882 | B2 | 4/2012 | Grigar et al. | |
| 8,540,027 | B2 | 9/2013 | Wesson et al. | |
| 9,085,969 | B2 * | 7/2015 | Clay | E21B 43/117 |
| 9,587,464 | B2 | 3/2017 | Jani | |
| 9,644,454 | B2 | 5/2017 | Jani | |
| 9,840,890 | B2 | 12/2017 | Nordheimer | |
| 9,840,892 | B2 | 12/2017 | Nordheimer | |
| 10,246,974 | B2 | 4/2019 | Greenway et al. | |
| 11,111,763 | B2 | 9/2021 | Shields | |
| 2014/0000894 | A1 | 1/2014 | Coffey et al. | |
| 2018/0266225 | A1 | 9/2018 | Kemick | |
| 2019/0063186 | A1 | 2/2019 | Fonseca et al. | |
| 2019/0345801 | A1 | 11/2019 | Shields | |
| 2022/0065079 | A1 * | 3/2022 | Alkhalidi | E21B 33/10 |

FOREIGN PATENT DOCUMENTS

| | | | | |
|---|---|---|---|---|
| CA | 2953571 | A1 * | 2/2016 | E21B 33/124 |
| CA | 2927850 | A1 | 7/2016 | |
| CA | 2916982 | A1 | 6/2017 | |
| EP | 2401474 | B1 | 12/2019 | |
| WO | WO-0065195 | A1 * | 11/2000 | E21B 43/117 |
| WO | 200165063 | A1 | 9/2001 | |

OTHER PUBLICATIONS

International Search Report and Written Opinion dated Dec. 16, 2021, for Application No. PCT/US2021/048501.

* cited by examiner

CASING DEPLOYED WELL COMPLETION SYSTEMS AND METHODS

CROSS-REFERENCE TO RELATED APPLICATIONS

This application is a continuation-in-part of U.S. non-provisional patent application Ser. No. 17/009,559 filed Sep. 1, 2020, and entitled "Behind Casing Well Perforating and Isolation System and Related Methods," which is hereby incorporated herein by reference in its entirety for all purposes.

STATEMENT REGARDING FEDERALLY SPONSORED RESEARCH OR DEVELOPMENT

Not applicable.

BACKGROUND

Hydrocarbons in the form of crude oil and/or natural gas may be used for a variety of productive purposes including in the making of gasoline and other oil-based products. Hydrocarbons may be produced by drilling of a wellbore by a drilling system including a drill bit that cuts into the formation to continuously extend the wellbore therethrough. The wellbore may extend from the surface and through a hydrocarbon-bearing subterranean earthen formation. In at least some applications, at least a portion of the wellbore may be cased whereby a casing string is installed against a wall of the wellbore as the wellbore is drilled in order to establish and maintain wellbore integrity. For example, a section of the casing string may be installed into an "open-hole" section of the wellbore immediately after the given openhole section is drilled followed by the performance of a cementing operation in which cement is pumped into the annulus formed between the wall of the wellbore and the installed casing section. Following drilling and completion of the drilled wellbore, hydrocarbons from the formation may be communicated from the formation, into the wellbore, and from the wellbore to the surface using a production system.

Many different methods exist by which the hydrocarbons may be conveyed to the surface via the wellbore. For example, oil may be recovered with artificial lifting mechanisms such as beam pumps, electrical submersible pumps, or by injecting fluids such as water, steam, or carbon dioxide into a reservoir to increase formation pressure and enable the hydrocarbons to flow to surface. Using this exemplary method, the recovery rate of hydrocarbons from the formation is based at least in part on the geology of the formation. Particularly important to the recovery rate is the permeability and the porosity of the formation. For instance, Shale rock formations tends to be more impermeable, inhibiting fluid flows while more permeable Sandstone rock formation allows fluids to flow more freely yielding higher recovery rates.

In at least some applications, when attempting to recover hydrocarbons from an unconventional and relatively impermeable formation, the wellbore and surrounding formation may be stimulated or "completed" to increase formation permeability and in-turn the recovery rate of hydrocarbons from the wellbore. For instance, explosives, acid injection, and/or hydraulic fracturing of the surrounding formation may be utilized to increase the permeability of the formation, with hydraulic fracturing generally being the most common technique of completing oil and gas wellbores.

Hydraulic fracturing or "fracking" is a well completion technique that typically involves injecting fracking fluids comprising water, chemicals, and proppants under high pressure into the formation to thereby form fractures within the formation through which hydrocarbons may be communicated to the wellbore during the production phase. After the fracking of the wellbore (or a given production zone of the wellbore) is completed, the injected fracking fluids are permitted to flow back from the wellbore to the surface while depositing proppant (e.g., sand, ceramic materials, etc.) within the fractures formed in the formation to thereby "prop" open the fractures so that they may remain open for the communication of hydrocarbons during the production phase. Recently, hydraulic fracking has become a widespread completion method because of increased recovery rates and new accessibility to unconventional subterranean reservoirs such as shale formations, tight sands and coals beds brought about by advances in drilling technology. Hydraulic fracking in conjunction with new drilling techniques like directional drilling, multi-well pads, seismic monitoring, and the like, has changed the economics and the landscape of shale gas production leading to a fracking boom in the United States.

SUMMARY

An embodiment of a system for completing a wellbore extending through a subterranean earthen formation includes a casing string positioned in a wellbore extending through a subterranean earthen formation, a first perforating assembly coupled to the casing string, wherein the first perforating assembly includes a first perforation charge coupled to the casing string, wherein the perforation charge includes an explosive material configured to blast towards the earthen formation upon detonation of the first perforation charge, and a first sealing device coupled to the casing string, wherein the first sealing device includes a closed position configured to restrict fluid flow across the first sealing device when in the closed position. In some embodiments, the first perforation charge is positioned radially between the casing string and a sidewall of the wellbore. In some embodiments, the first perforation charge comprises a first explosive assembly configured to eject the stream of material towards the earthen formation, and a second explosive assembly configured to blast in an opposed direction towards the casing string. In certain embodiments, the first perforating assembly comprises an outer sleeve coupled to an outer surface of the casing string and comprising a receptacle which receives the first perforation charge. In certain embodiments, the system comprises a surface communication system in signal communication with the first perforating assembly, wherein the first perforating assembly comprises a perforation charge initiator coupled to the casing string, wherein the perforation charge initiator is configured to detonate the first perforation charge in response to receiving a detonation signal transmitted by the surface communication system. In some embodiments, the system comprises a control system a control system in signal communication with the perforation charge initiator, wherein the control system is configured to transmit an identifier with the detonation signal that uniquely identifies the perforation charge initiator. In some embodiments, the first perforating assembly comprises a first isolation valve comprising the first sealing device, and wherein the first isolation valve comprises a valve initiator and a valve release assembly configured to maintain the first sealing device in the open position and to permit the first sealing device to actuate into the closed position in response to a detonation of the valve initiator. In certain embodiments, the first perforation charge is received within an aperture formed in the casing string. In certain embodiments, the system comprises a second perforating assembly coupled to the casing string and spaced from the first perforating assembly along the casing string, wherein the second perforating assembly comprises a second perforation charge coupled to the casing string, wherein the perforation charge comprises an explosive material configured to blast towards the earthen formation upon detonation of the second perforation charge, and a second sealing device coupled to the casing string, wherein the second sealing device comprises a closed position configured to restrict fluid flow across the second sealing device when in the closed position. In some embodiments, the first perforating assembly is associated with a first production zone of the earthen formation and the second perforating assembly is associated with a separate, second production zone of the earthen formation. In some embodiments, the casing string is secured to a sidewall of the wellbore by cement located in annulus formed between the casing string and the sidewall of the wellbore.

An embodiment of a method for completing a wellbore extending through a subterranean earthen formation comprises (a) installing a casing string and a first perforating assembly coupled to the casing string into the wellbore extending through the earthen formation, (b) actuating a first sealing device of the first perforating assembly from an open position to a closed position to restrict fluid flow across the first sealing device, and (c) detonating a first perforation charge of the first perforating assembly to provide fluid communication between a central passage of the casing string and the earthen formation through an opening formed by the detonated first perforation charge. In some embodiments, (b) comprises detonating a valve initiator to release a release assembly coupled to the first sealing device and thereby permit the first sealing device to actuate into the closed position. In some embodiments, (c) comprises transmitting a detonation signal from a surface communication system to a perforation charge initiator coupled to the casing string whereby the perforation charge initiator detonates the first perforation charge in response to receiving the detonation signal. In certain embodiments, the method comprises (d) activating a surface pump to increase fluid pressure within the central passage of the casing string prior to (c) such that at least a portion of the central passage is at a fracturing pressure when the first perforation charge of the first perforating assembly is detonated. In certain embodiments, (a) comprises installing a second perforating assembly coupled to the casing string in the wellbore, wherein the second perforating assembly is spaced along the casing string from the first perforating assembly, and the method further comprises (d) actuating a second sealing device of the second perforating assembly from an open position to a closed position to restrict fluid flow across the second sealing device, and (e) detonating a second perforation charge of the second perforating assembly to provide fluid communication between a central passage of the casing string and the earthen formation through an opening formed by the detonated second perforation charge.

An embodiment of a method for completing a wellbore extending through a subterranean earthen formation comprises (a) actuating a first sealing device located in a string assembly positioned in the wellbore from an open configuration to a closed configuration whereby fluid flow across the first sealing device and further downhole through the string assembly is restricted, (b) detonating a first perforation charge uphole from the first sealing device to provide fluid communication between a central passage of the string assembly and the earthen formation through a first opening in the string assembly formed by the detonated first perforation charge, (c) elevating a hydraulic pressure within the central passage of the string assembly to communicate a fracturing fluid through the first opening and hydraulically fracturing the earthen formation, (d) actuating a second sealing device located in the string assembly uphole from the first dealing device and the first opening from an open configuration to a closed configuration whereby fluid flow across the second sealing device and further downhole through the string assembly is restricted, and (e) detonating a second perforation charge uphole from the second sealing device to provide fluid communication between the central passage of the string assembly and the earthen formation through a second opening in the string assembly formed by the detonated second perforation charge, and (f) maintaining the elevation of the hydraulic pressure within the central passage of the string assembly through steps (a) through (e) whereby the fracturing fluid is communicated through the second opening to hydraulically fracture the earthen formation. In some embodiments, the method comprises (g) activating a surface pump to increase the hydraulic pressure within the central passage of the string assembly prior to the detonation of the first perforation charge. In some embodiments, (a) comprises detonating a valve initiator to release a release assembly coupled to the first sealing device and thereby permit the sealing device to actuate into the closed position. In certain embodiments, (b) comprises transmitting a detonation signal from a surface communication system to a perforation charge initiator coupled to the string assembly whereby the perforation charge initiator detonates the first perforation charge in response to receiving the detonation signal. In some embodiments, (f) comprises maintaining a surface pressure of the fracturing fluid at a pressure that is at least 50% of a surface pressure of the fracturing fluid utilized to hydraulically fracture the earthen formation at (c).

BRIEF DESCRIPTION OF THE DRAWINGS

For a detailed description of exemplary embodiments of the disclosure, reference will now be made to the accompanying drawings in which.

DETAILED DESCRIPTION

Figure 1:
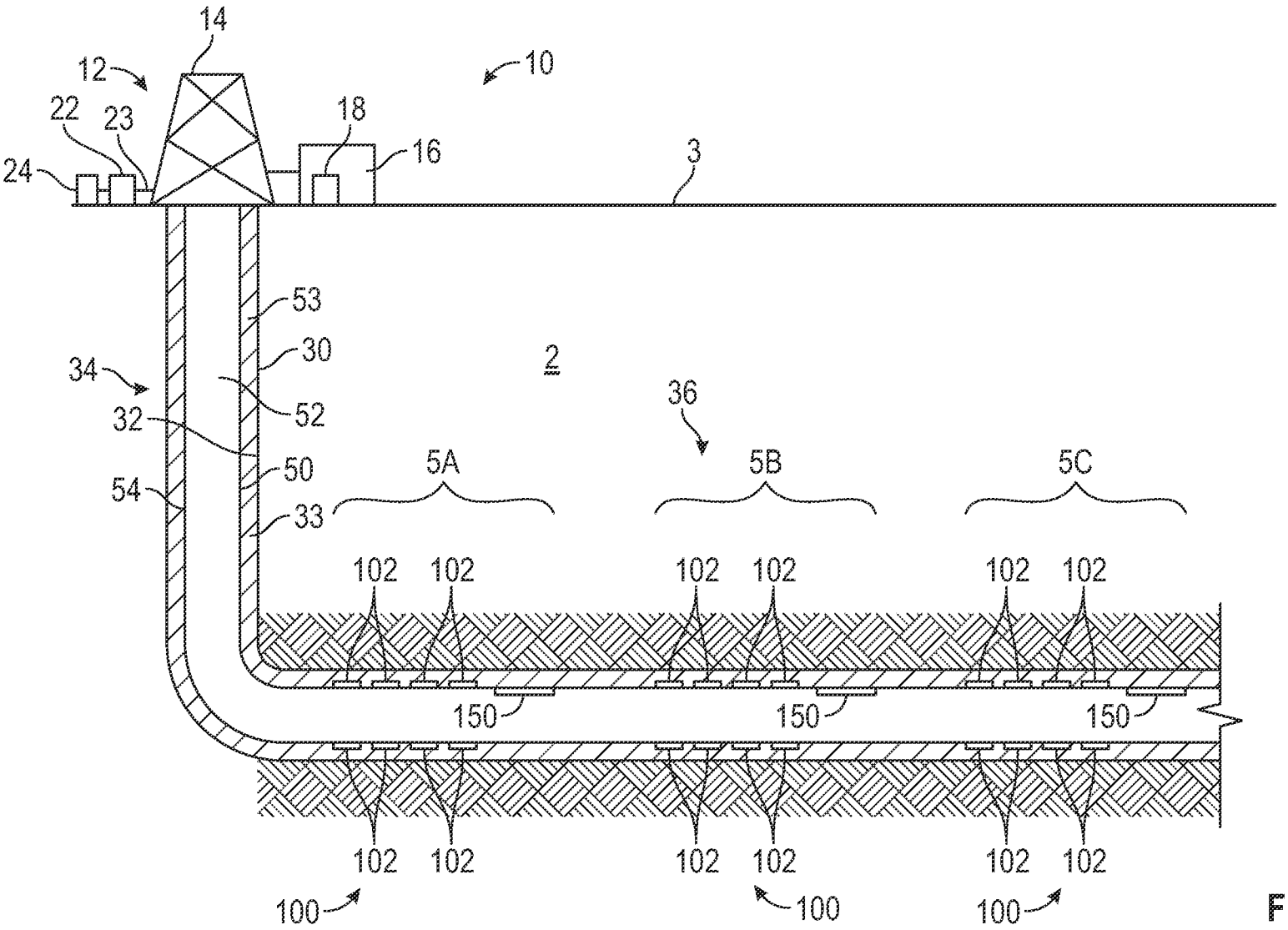
FIGS. 1-4 are schematic views of an embodiment of a well system.
Figure 2:
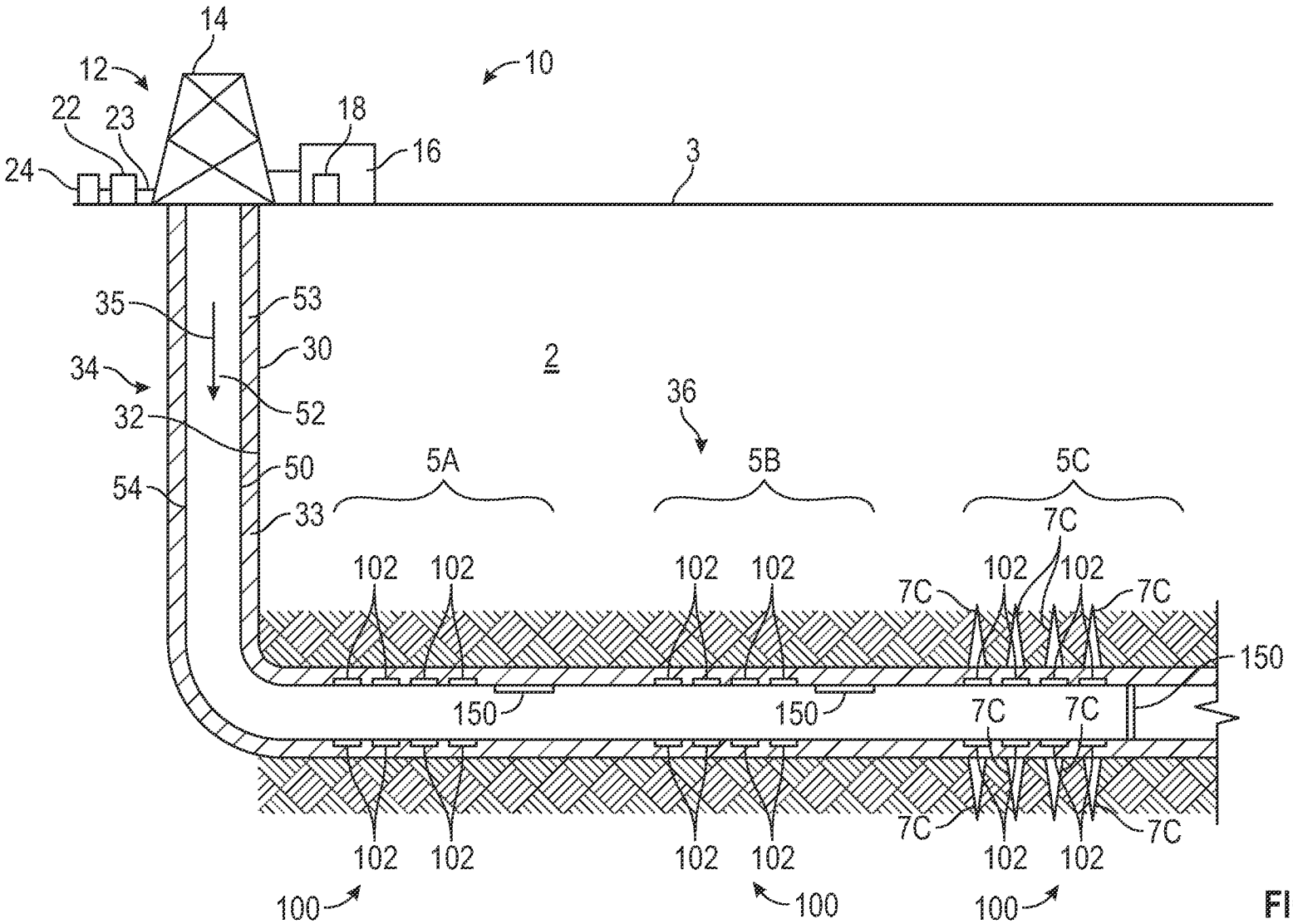
Figure 3:
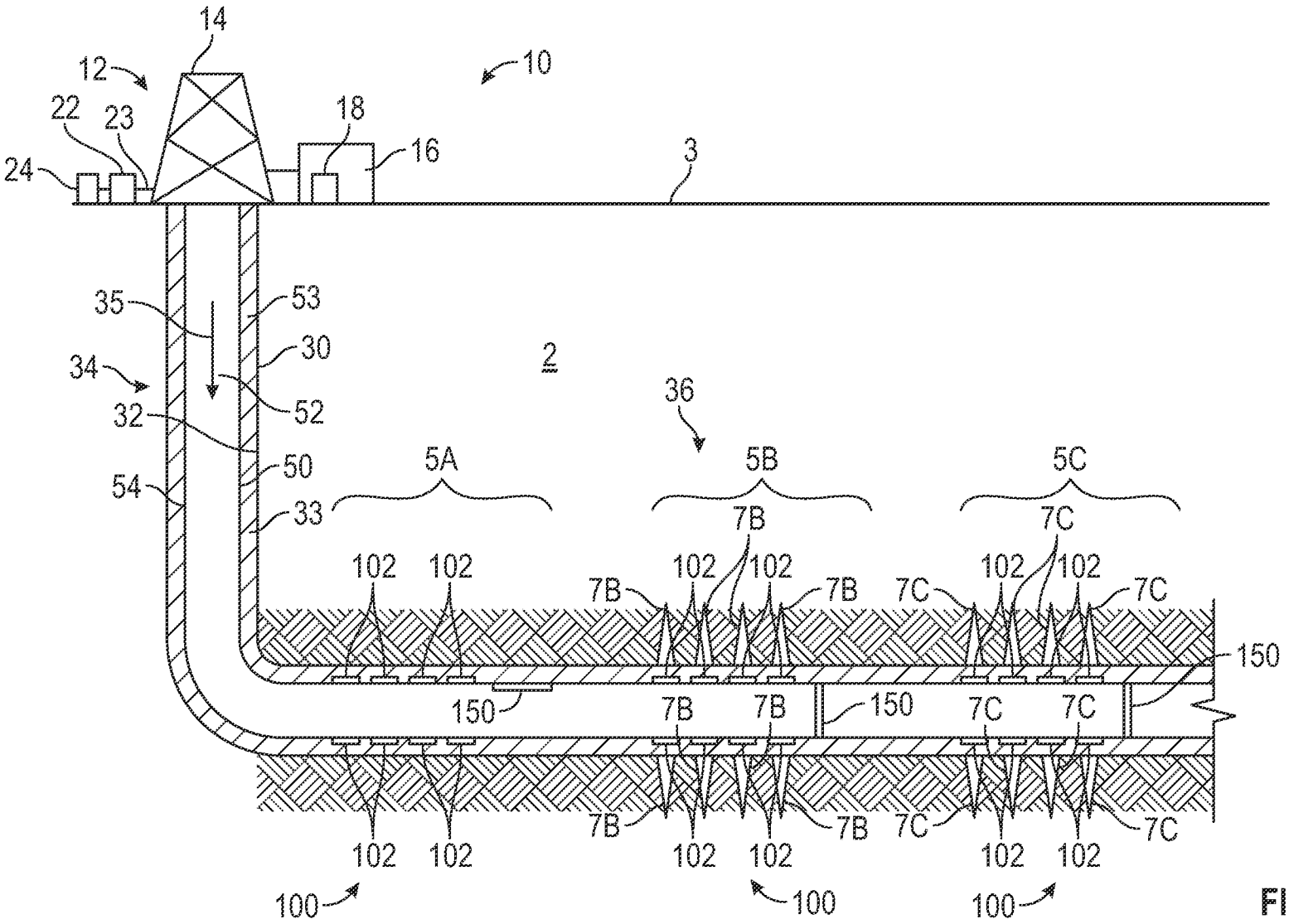
Figure 4:
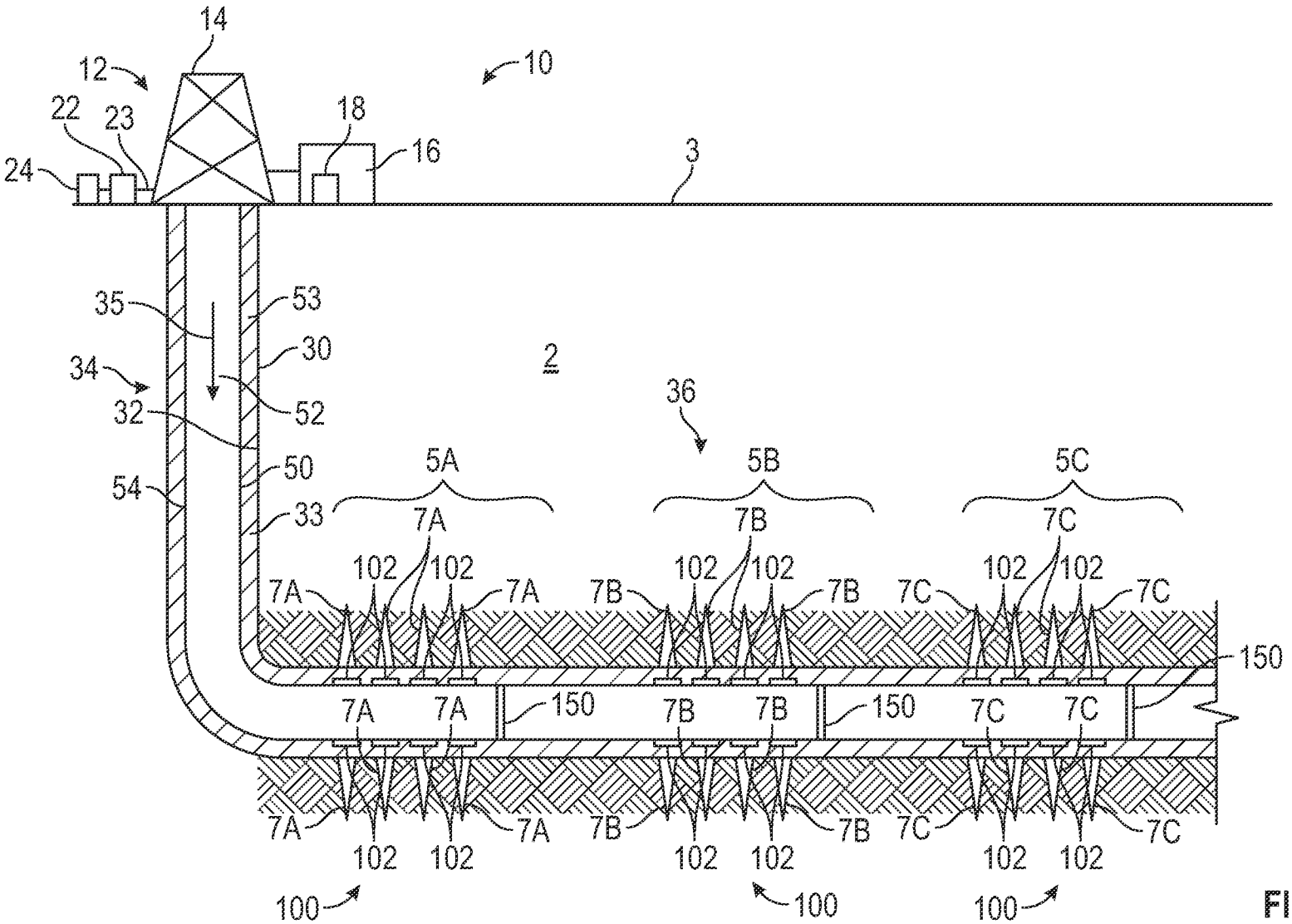

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation.

As described above, wellbores extending through subterranean earthen formations may be completed prior to the production phase in order to increase the permeability of the formation surrounding a wellbore extending into the formation. A common technique for completing the formation includes hydraulically fracturing the formation whereby a plurality of fractures extending into the formation from the wellbore are formed and/or reopened via the injection of pressurized and proppant containing fracturing fluid into the formation from the wellbore. In at least some applications, the casing string extending along the wellbore may be first perforated by a perforating device prior to hydraulically fracturing the formation. Particularly, the perforations in the casing string may provide a conduit for the fracturing fluid as it is injected into the formation from the wellbore.

In at least some applications, the wellbore may be completed in separate or discrete stages extending along the length of the wellbore. For instance, the formation may be hydraulically fractured in 30 to 60, for example, separate stages, where each stage is spaced along the wellbore from the other fracturing stages. Each stage may include a sealing device to provide pressure isolation and one or more clusters (e.g., 5 to 30 clusters) of perforations in the casing string distributed across the stage and associated with a specific perforation ("shot") size, number of perforations per foot, and a specific orientation across the casing string depending on the particular application.

Hydraulic fracturing operations are commonly performed on new wells to increase productivity where high volume, high pressure pumps are brought to the wellbore to impose fracturing fluid comprising sand, and chemicals mixed with water in the wellbore up to about 15,000 pounds per square inch gauge (PSIG) (measured at the surface) but typically up to a pressure defined in a well development plan created by operators of the completion system used to perform the hydraulic fracturing operation. Most commonly, hydraulic fracturing is now performed in conjunction with wireline deployable perforating gun systems referred to sometimes as pump down perforating (PDP) and Plug and Perf (PNP) systems. In wireline deployable systems, a perforating assembly comprising a sealing device or plug and one or more perforating guns are pumped from the surface via activating surface pumps to a desired depth within the wellbore once the wellbore has been completely drilled and cased. Once at the desired depth, the plug may be set to isolate the given stage and the one or more perforating guns may be initiated to form the perforations through the surrounding casing string and cement sheath associated with the given stage. Signals for setting the plug and initiating the one or more perforating guns may be communicated to the perforating assembly from the surface via the wireline cable extending therebetween. In some applications, the one or more perforating guns may be retracted a distance uphole to a desired firing location following the setting of the plug. Additionally, when the perforating assembly comprises a plurality of guns, the perforating assembly may be transported uphole to a subsequent desired location following the firing of each perforating gun of the assembly.

Following the firing each perforating gun of the assembly, the perforating assembly (sans the plug which is secured to the casing string) is conveyed to the surface by retracting the wireline cable coupled to the perforating assembly. With the perforating assembly retrieved to the surface, the portion of the formation associated with the given stage may be hydraulically fractured by reactivating the surface pumps and pumping pressurized fracturing fluid from the surface and into the formation via the perforations in the casing string formed by the one or more perforating guns. This process may be repeated for each subsequent stage of the hydraulic fracturing operation.

As described above, conventional wireline deployable fracturing systems require the repeated pumping of the perforating assembly into the wellbore and the retrieval of the perforating assembly from the wellbore for each stage of the fracturing operation, when a given fracturing operation may include dozens of different stages and corresponding dozens of deployments and retrievals of different perforating assemblies. Moreover, following the fracturing of each stage, coiled tubing may be inserted into the wellbore in order to drill out the plug of each stage so that hydrocarbons may be communicated from the wellbore to the surface. Thus, conventional wireline deployable fracturing systems may require an extended period of time to perform the fracturing of a plurality of stages given the number of deployments and retrievals of the perforating assemblies which must be completed during the performance of the fracturing operation. The repeated deployments and retrievals of the perforating assembly result in the surface pumps often not being utilized for the pumping of fracturing fluid into the wellbore. Instead, the majority of the time is spent on transporting the perforating assemblies utilized in the fracturing operation through the wellbore. The inefficiencies and extended time required for performing a fracturing operation using a wireline deployable fracturing system may thus lead to a high level of cost associated with performing the fracturing operation due to, for example, the expense associated with operating the equipment comprising the wireline deployable fracturing system over an extended period of time.

Accordingly, embodiments disclosed herein include systems for completing a subterranean earthen formation including a casing deployed perforating assembly. Particularly, the perforating assemblies described herein may be integrated with or coupled to one or more casing joints of a casing string and may thus be installed in a wellbore along with the casing string. In this manner the requirement for deploying and retrieving a separate perforating assembly, after the wellbore has been drilled and cased, is eliminated. Instead, once the casing string has been installed the perforating assemblies installed along with the casing string may be immediately utilized to fracture one or more production zones of the earthen formation, thereby minimizing the time required for performing the completion operation. Additionally, the wellbore need not be vented between the completion of separate production zones to allow for the retrieval of the perforating assembly, and instead pressure may be maintained within the wellbore during the duration of the completion operation, further reducing the time required for performing the completion operation.

The casing deployed completion systems described herein may be preferable to traditional perforation systems because the casing deployed completion systems described herein may eliminate or at least substantially reduce the need for wireline operation, pumps, and water. The elimination of these components may create environmental, efficiency, and cost benefits. The elimination or reduction of the pumps has major potential environmental benefits. Pump elimination or reduction is estimated to save, on a yearly basis, billions of barrels of water, millions of gallons of diesel fuel, and decrease greenhouse gas emission (CO2, NOX, CO, unburned Hydrocarbons) by about 20 million metric tons. There may also be an anticipated 20% yearly cost reduction and an expected 30% gain in pumping hour efficiency due to elimination or reduction of pump down perforating methods, pumps, and water. The integrated casing well perforating and isolation system may facilitate a 30% fracking fleet reduction yielding a significant reduction in total asset costs.

The casing deployed completion systems described herein may also increase efficiency by eliminating standby time, well switching time, time lost during wireline operations, time spent opening and closing well heads, and time spent pressure testing between stages. The behind casing well perforating and isolation system is expected to increase fracking efficiency by roughly 40% to 60%, yielding more than 20 pumping hours daily. Further, the behind casing well perforating and isolation system may enable operators to frack each well completely before moving to the next well within same pad.

Referring now to FIGS. 1-4, a well system 10 is shown for producing hydrocarbons from a subterranean earthen formation 2 is shown. Well system 10 generally includes a surface assembly 12 positioned at the surface 3, a wellbore 30 extending into the earthen formation from the surface 3, a string assembly or "casing string" 50 positioned within the wellbore 30, and a plurality of perforating assemblies 100. In lieu of or in addition to producing hydrocarbons from earthen formation 2, well system 10 also comprises a system for completing the wellbore 30 to thereby increase fluid conductivity between the earthen formation 2 and the wellbore 30. Thus, well system 10 may also be referred to herein as a completion system 10. In some embodiments, well system 10 may include equipment in addition to that shown in FIGS. 1-4. For example, well system 10 may include well isolation equipment such as one or more blowout preventers (BOPs) for preventing an inadvertent release of fluid from the wellbore 30 to the surrounding environment.

In this exemplary embodiment, surface assembly 12 generally includes a derrick or rig 14, a surface pump system 16 comprising one or more hydraulic pumps 18, and a downhole communication system 22. Rig 14 supports components utilized in the drilling of wellbore 30 and the installation of casing string 30. For example, rig 14 may support a drill string having a drill bit (not shown in FIGS. 1-4) connected to an end thereof via a block-and-tackle and winch system. A rotary table or top drive of the rig 14 may rotate the drill string from the surface 3 to thereby rotate the drill bit and cut into the earthen formation 2 to extend the wellbore 30 through earthen formation 2. Rig 14 may utilize similar equipment for installing sections of the casing string 30 after an openhole portion of wellbore 30 has been drilled. In some embodiments, well system 10 may not include rig 14 and its associated equipment. For example, in some embodiments, surface assembly 12 may only comprise surface pump system 16 and communication system 22 and equipment associated with systems 16, 32.

The surface pump system 16 of surface assembly 12 is configured to pump pressurized fluid into and through a central passage 52 of the casing string 30 from the surface 3. For example, surface pump system 16 may pump pressurized drilling fluid or mud through the drill string during the drilling of wellbore 30 for cooling and/or powering the drill bit attached to the end of the drill string. In some embodiments, the surface pump system 16 is also configured to pump cement 33 down through the central passage 52 of the casing string 30 and then upwardly through an annulus 53 formed radially between the casing string 30 and a sidewall 32 of the wellbore 30 such that the cement 33 isolates the central passage 52 of the casing string 30 from the earthen formation 2. In other embodiments, a separate surface pump system of surface assembly 12 may pump cement 33 and/or drilling fluid through the wellbore 30.

Further, in this exemplary embodiment, surface pump system 16 is configured to pump a pressurized hydraulic fracturing fluid through the central passage 52 of casing string 30. For example, surface pump system 16 may pump a hydraulic fracturing fluid comprising water, proppant (e.g., silica sand, ceramic proppant, etc.), and potentially one or more chemical additives (e.g., a friction reducer, a surfactant, etc.) at a pressure of typically between about 5,000 pounds per square inch gauge (PSIG) (e.g., 5,000 PSI above ambient surface air pressure) and 15,000 PSIG. Thus, the desired fracturing pressure for a given application may range approximately between 5,000 PSIG and 15,000 PSIG; however, in other embodiments, the discharge pressure of surface pump system may vary depending upon the particular application. As will be discussed further herein, well system 10 is configured to inject the fracturing fluid pumped by surface pump system 16 into specific locations of the earthen formation to thereby form hydraulic fractures within the formation 2 and which may remain "propped" open by the proppant of the fracturing fluid which remains in the fractures after the fracturing fluid is permitted to flow back into the wellbore 30.

The communication system 22 of surface assembly 12 is configured to communicate signals and/or data to downhole components located in wellbore 30. In some embodiments, communication system 22 may also receive signals and/or data from downhole components located in wellbore 30. For example, communication system 22 may be in signal communication with one or components of casing string 30 as will be described further herein. In this manner, the communication system 22 may selectably actuate components of casing string 30. In this exemplary embodiment, communication system 22 is configured to communicate with downhole components via an electrical cable 23 extending from the communication system 22 downhole into wellbore 30. Thus, in this exemplary embodiment, communication system 22 comprises a wired communication system having a wired connection (via electrical cable 23) with downhole components of well system 10 positioned in wellbore 30.

Figure 5:
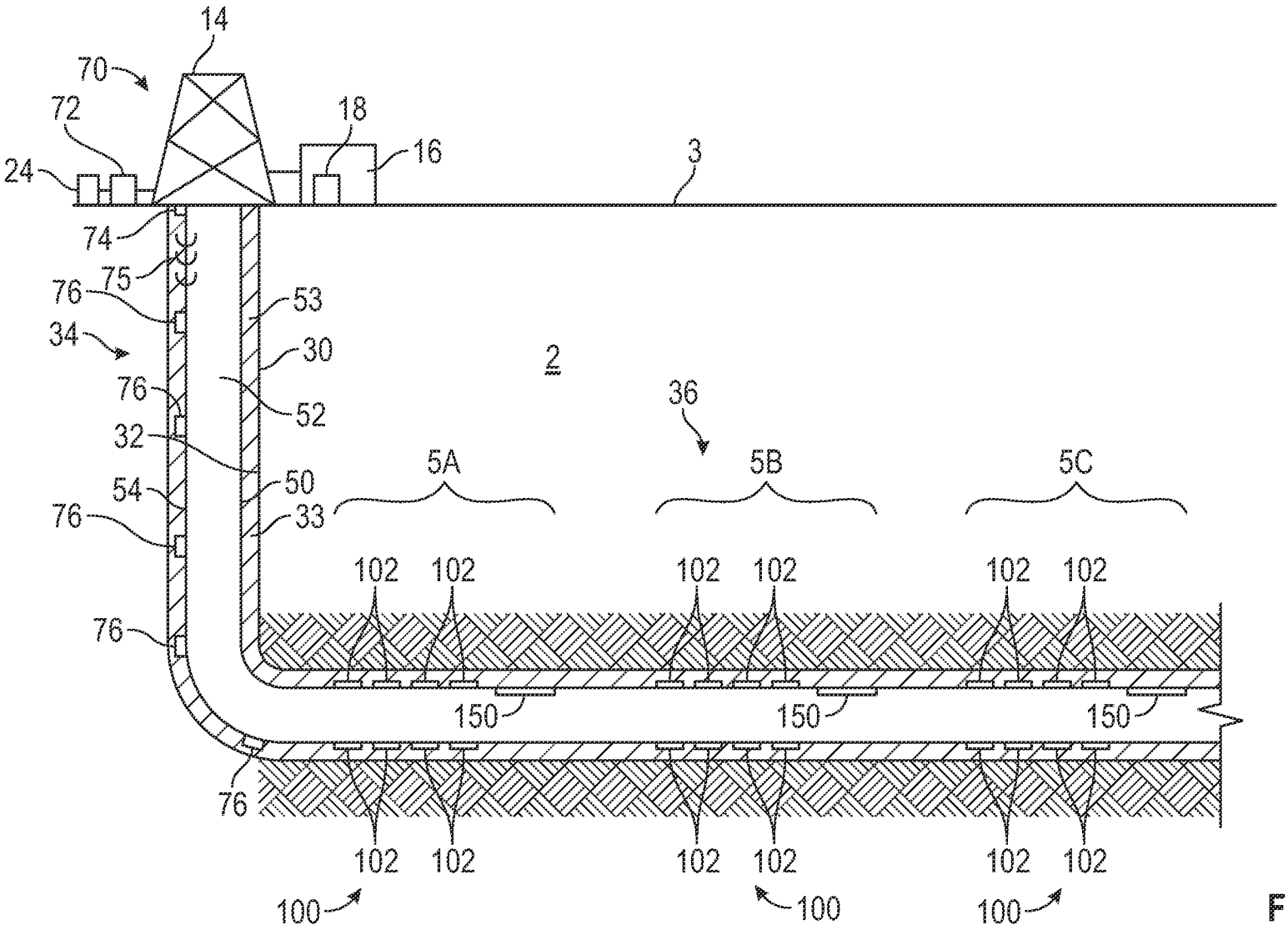
FIGS. 5-7 are schematic views of additional embodiments of well systems.

In other embodiments, communication system 22 may be configured to communicate wirelessly with downhole components of well system 10 positioned in wellbore 30. For example, referring briefly to FIG. 5, another embodiment of a well system 70 is shown comprising a wireless communication system 72 configured to communicate acoustically with downhole components of well system 70. Wireless communication system 72 comprises an acoustic transmitter 74 positioned at or near the surface 3 and a plurality of acoustic repeaters 76 coupled to and spaced along the casing string 50. The acoustic transmitter 74 is configured to produce and transmit an acoustic signal in the form of a plurality of acoustic waves 75 through the casing string 50. The plurality of acoustic repeaters 76 of communication system 72 are configured to receive and transmit or repeat the acoustic signal further along the casing string 50 such that the signal can be received by components of well system 70 positioned farther downhole within wellbore 30.

Figure 6:
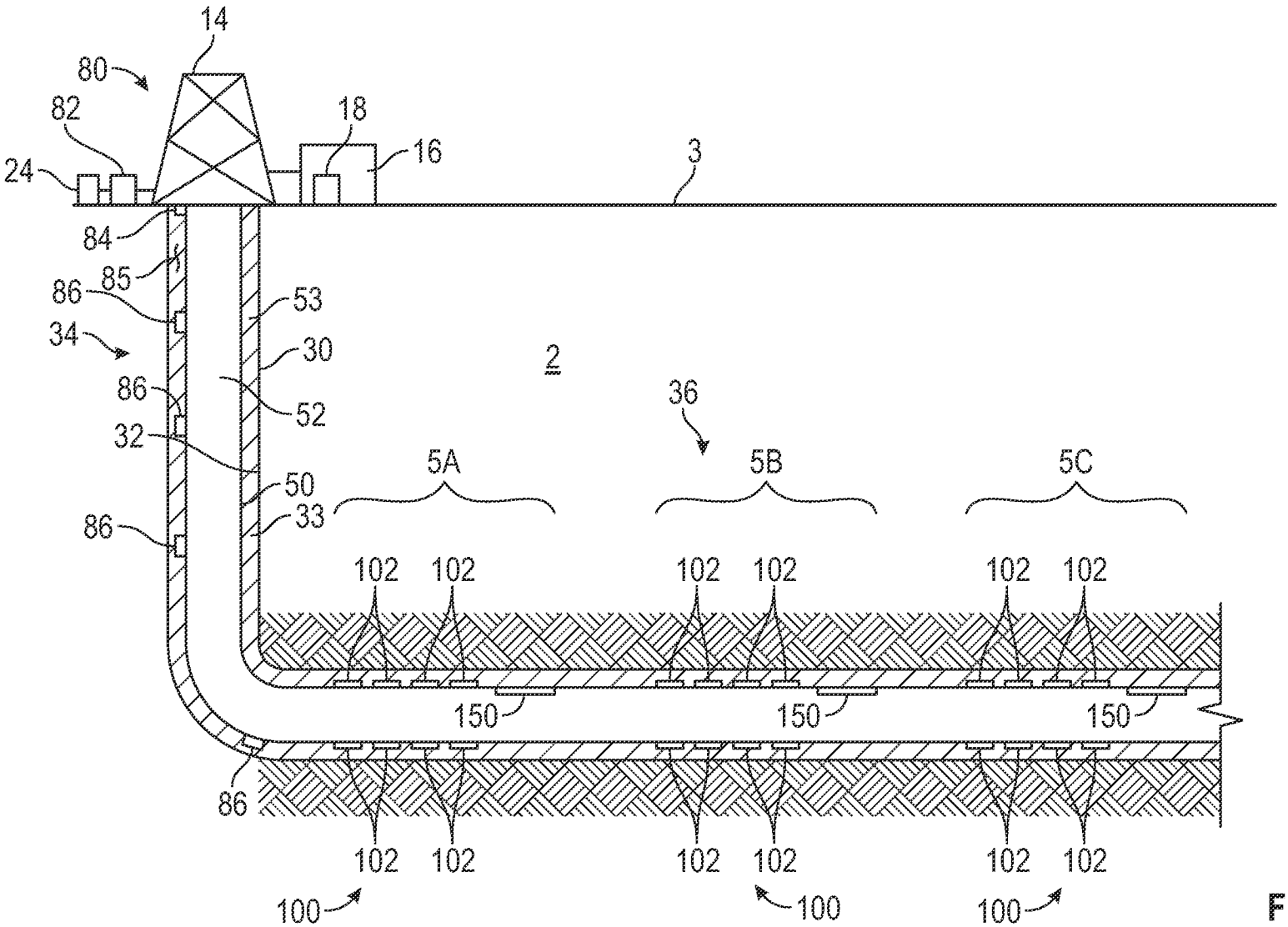

Referring briefly to FIG. 6, another embodiment of a well system 80 is shown comprising a wireless communication system 82 which includes an electromagnetic transmitter 84 positioned at or near the surface 3 and configured to communicate electromagnetically with downhole components (comprising electromagnetic receivers) of well system 80. Particularly, electromagnetic transmitter 84 is configured to transmit electromagnetic waves 85 through casing string 50 and/or earthen formation 2 which may be received by downhole components of well system 80. In this exemplary embodiment, wireless communication system 82 additionally includes a plurality of electromagnetic repeaters 86 coupled to and spaced along the casing string 50. The plurality of electromagnetic repeaters 86 of communication system 82 are configured to receive and transmit or repeat the electromagnetic signal further along the casing string 50 such that the signal can be received by components of well system 80 positioned farther downhole within wellbore 30.

Figure 7:
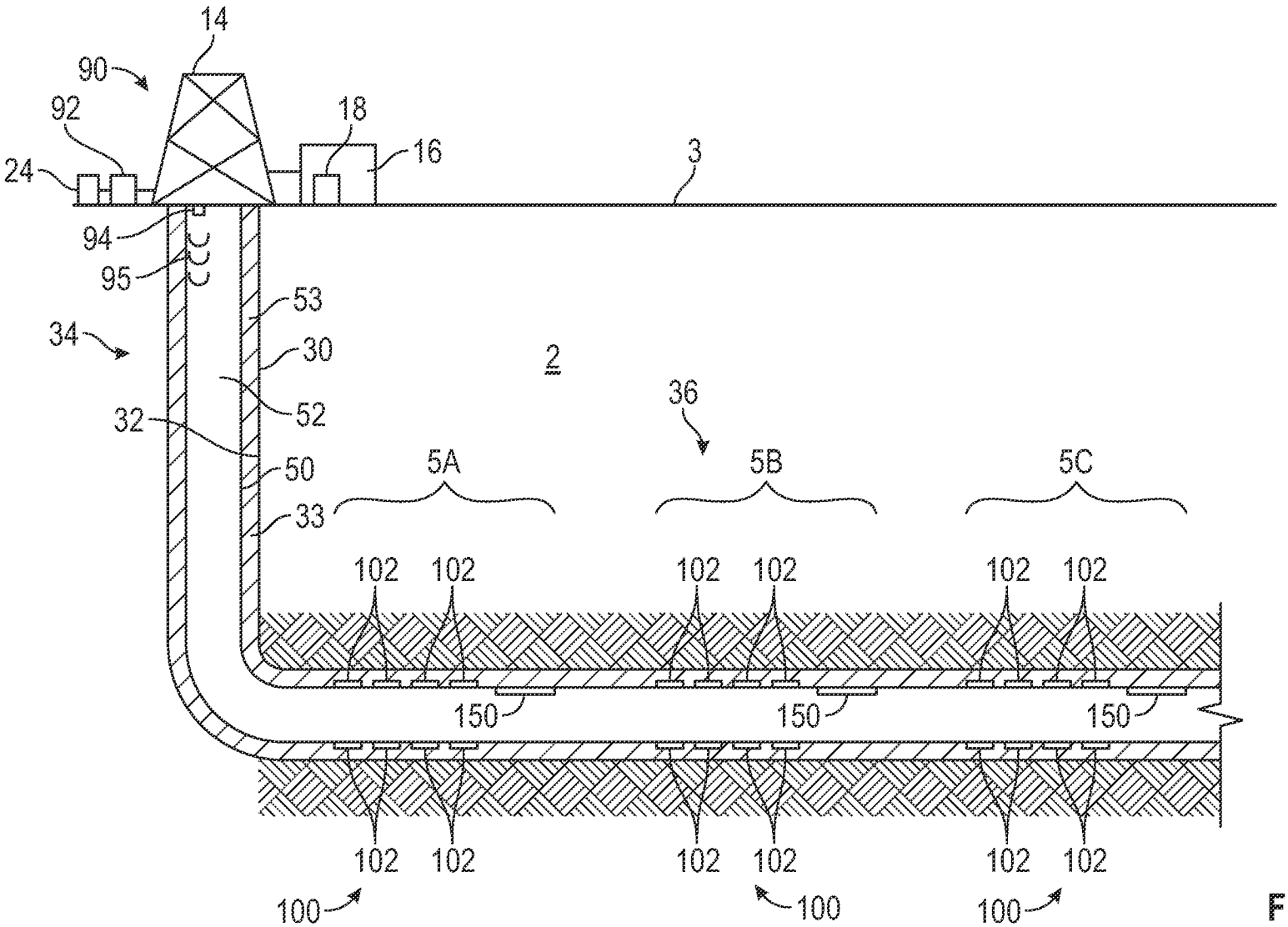

Referring to FIG. 7, a further embodiment of a well system 90 is shown comprising a wireless communication system 92 which includes a pressure pulse transmitter 94 positioned at or near the surface 3. Pressure pulse transmitter 92 is configured to generate a plurality of fluid pressure pulses 95 communicable through the fluid located within the central passage 52 of casing string 50 to downhole components of wellbore system 90. The pressure pulse transmitter 92 may comprise a telemetry pump or variable pressure source. Signals embedded within the pressure pulses 93 may be converted into an amplitude or frequency modulated pattern received by pressure receivers of the downhole components configured to communicate with the pressure pulse transmitter 94.

Referring again to FIGS. 1-4, in this exemplary embodiment, communication system 22 is controlled by a control system 24 of well system 10 that is in signal communication with communication system 22. Particularly, control system 24 is configured to control the operation of communication system 22 and thereby control the signals and/or data transmitted between communication system 22 and downhole components of well system 10 positioned in wellbore 30. In some embodiments, control system 24 may be operated manually by personnel of well system 10. In other embodiments, control system 24 may be automated such that control system 24 is configured to operate one or more downhole components of well system 10 in accordance with a pre-programmed operational plan stored in a memory of control system 24.

In this exemplary embodiment, wellbore 30 comprises a deviated wellbore having a vertical section 34 and a horizontal or deviated section 36 extending from a heel located at a lower end of the vertical section 34 and a toe defining a terminal end of the wellbore 30. In this configuration, the horizontal section 36 of wellbore 30 may extend through a reservoir or hydrocarbon bearing portion of the earthen formation 2 targeted for the production of hydrocarbons. While in this exemplary embodiment wellbore 30 comprises a deviated wellbore 30, in other embodiments the configuration of wellbore 30 may vary.

In this exemplary embodiment, the casing string 50 of well system 10 comprises a plurality of metallic (e.g., steel alloy) tubular casing joints connected end-to-end via threaded connections such as, for example, rotary shouldered threaded connections. The interfaces between each casing joint may be sealed via a metal-to-metal seal formed between each casing joint. As described above, the casing string 50 may be installed during the drilling of wellbore 30. Particularly, casing string 50 may be installed in intervals where an openhole section of wellbore 30 is drilled, followed by the installation of a section of casing string 50 covering the openhole interval, followed again by the subsequent drilling of another openhole interval of wellbore 30 which is again cased by another section of casing string 50. In this exemplary embodiment, casing string 50 is cemented into position within wellbore 30 and casing string 50 acts to isolate the central passage 52 of string 50 from the earthen formation 2 whereby fluid communication between earthen formation and central passage 52 may be restricted.

Perforating assemblies 100 of well system 10 are integrated into the casing string 50 such that perforating assemblies 100 are coupled to and conveyed with the casing string 50 and thus are installed within wellbore 30 at the same time as casing string 50. Therefore, in this exemplary embodiment, each of the perforating assemblies 100 are installed within wellbore 30 once the casing string 50 has been fully installed and cemented into position within wellbore 30. In other words, there is no need to convey a separate string or wireline/slickline conveyed perforating assembly into wellbore 30 following the installation of casing string 50. Instead of needing to convey one or more strings or lines comprising one or more perforating assemblies into the casing string 50 following installation thereof, the earthen formation 2 may be immediately stimulated once casing string 50 is installed within wellbore 30. Unlike conventional practice, in use, the casing string 50 with pre-installed and integrated perforating assemblies 100 avoids the need for perf guns and isolation valves to be installed by separate equipment at a later time and in the middle of the completion operation.

In this exemplary embodiment, each perforating assembly 100 is associated with a different hydrocarbon bearing zone 5A-5C of the earthen formation 2. Particularly, each perforating assembly 100 is configured to selectably produce fluid communication between the central passage 52 of casing string 50 and one of the zones 5A-5C of earthen formation 2 (e.g., an uppermost perforating assembly 100 may establish fluid communication with first zone 5A, etc.) While only three separate zones 5A-5C are shown in FIGS. 1-4, well system 100 may be configured to establish fluid communication between casing string 50 and dozens of separate and distinct zones (e.g., 20-80 zones) of earthen formation 2. The number and spacing of the perforating assemblies 100 is entirely flexible being as many and in whatever orientations desired by those designed the casing string 50 for a specific wellbore 30 and zone 5A-5C.

In this exemplary embodiment, each perforating assembly 100 includes a plurality of explosive shaped or perforation charges 102 and an isolation valve 150. Perforation charges 102 and isolation valve 150 are each controllable from the surface using control system 24. Perforation charges 102 each comprise an explosive material and, upon detonation, are configured to emit a high-velocity jet of material that penetrates through the cement 33 and into the earthen formation 2 whereby fluid communication is established between the central passage 52 of casing string 50 and the zone 5A-5C associated with the particular perforating assembly 100. Perforation charges 102 may be integrated directly within the casing string 50 (e.g., a tubular member which connects directly with joints of casing string 50) or perforation charges 102 may be located in an outer housing which is positioned about an outer surface 54 of the casing string 52. When perforation charges 102 are located radially outside of casing string 50, perforation charges 102 may be, in addition to configured for penetrating cement 34, be configured to emit a high-velocity jet which penetrate the casing string 50.

The isolation valve 150 of each perforating assembly 100 is generally configured to selectably isolate the portion of the casing string 50 extending uphole from the isolation valve 150 from the portion of the casing string 50 extending downhole from the given isolation valve 150. In this manner, isolation valve 150 may isolate an uphole portion of the central passage 52 of casing string 50 from zones 5B, 5C, etc., located downhole from the isolation valve 150 such that a fracturing pressure may be realized within the uphole portion of central passage 52.

FIGS. 1-4 illustrate an exemplary sequence of operations for completing each of the zones 5A-5C of earthen formation utilizing well system 10 and the perforating assemblies 100 thereof. Particularly, following the installation of casing string 50, a closure signal generated by control system 24 may be communicated to the isolation valve 150 of the perforating assembly 100 associated with lowermost zone 5C via the communication system 22. The isolation valve 150 may then actuate from an open configuration to a closed configuration thereby fluidically isolating the portion of the central passage 52 of casing string 50 extending uphole from the closed isolation valve 150 from the portion of central passage 52 extending downhole from the closed isolation valve 150. Following the closure of the isolation valve 150, a firing or detonation signal provided by the control system 24 may be communicated to each of the perforation charges 102 of the perforating assembly 100 associated with lowermost zone 5C, causing each of the perforation charges 102 associated with lowermost zone 5C to detonate and thereby form perforations in the cement 33 (and potentially the casing string 50 itself).

Following the detonation of the perforation charges 102 associated with lowermost zone 5C, fluid communication is established between the central passage 52 of casing string 50 and the lowermost zone 5C of earthen formation 2. In this configuration, the one or more pumps 18 of surface pump system 16 may be activated to pump pressurized fracturing fluid (indicated by arrow 35 in FIGS. 2-4) through the perforations formed by the detonated perforation charges 102 and into the lowermost zone 5C of earthen formation 2. In this exemplary embodiment, fracturing fluid is pumped by the one or more pumps 18 into the lowermost zone 5C to thereby form hydraulic fractures 7C therein, as shown particularly in FIG. 2.

In some embodiments, the one or more pumps 18 may be activated prior to the detonation of the perforation charges 102 associated with lowermost zone 5C to thereby allow a pre-defined, desired fracturing pressure to be established within the central passage 52 of casing string 50 before the perforation charges 102 are detonated. In some embodiments, the discharge pressure applied at surface by the one or more pumps 18 may range from just above 0% up to 100% of desired fracturing pressure (measured at the discharge of the one or more pumps 18 at the surface). For example, providing a discharge pressure from the one or more pumps 18 at 100% of desired fracturing pressure prior to or at the same time as the perforation charges 102 of perforating assembly 100 are detonated may assist in the formation of the fractures 7C. For example, rather than slowly building up to fracturing pressure following the detonation of perforation charges 102, unleashing the fracturing fluid at full fracturing pressure into zone 5C at the time perforation charges 102 are detonated may result in relatively greater fracturing (e.g., longer fractures, more developed fracture networks, etc.) of lowermost zone 5C.

Once a sufficient time period has elapsed and/or a sufficient amount of fracturing fluid has been delivered to the lowermost zone 5C, the isolation valve 150 of the perforating assembly 100 associated with intermediate zone 5B of earthen formation 2 may be closed to thereby isolate the portion of the central passage 52 of casing string 50 extending uphole from intermediate zone 5B from the portion of central passage 52 extending downhole from intermediate zone 5B. In other words, closing the isolation valve 150 associate with intermediate zone 5B isolates the lowermost zone 5C from the surface pump system 16. In some embodiments, surface pump system 16 may be shut-in once the isolation valve 150 associated with intermediate zone 5B has been closed to thereby maintain pressure within the uphole portion of the central passage 52 of casing string 50 at or near the fracturing pressure. In other words, pressure within the uphole portion of central passage 52 is not vented at the surface. In other embodiments, the one or more pumps 18 of surface pump system 16 may remain in activation thereby maintaining the desired fracturing pressure at the discharge of the one or more pumps 18 during and following the closure of the isolation valve 150 associated with intermediate zone 5B.

Thus, the surface pumping system 16 may be activated continuously and uninterruptedly during the fracturing of each of the zones 5A-5C of earthen formation 2. In this manner, the time required for repeatedly ramping up pressure within the casing string to fracturing pressure in conventional fracturing systems (to allow the string or wireline perforating assembly to be retrieved from the wellbore) may be avoided and instead pressure of the fracturing fluid at the discharge of the one or more pumps 18 may be maintained at or near the desired fracturing pressure once fracturing pressure is initially achieved in central passage 52 until the uppermost zone 5A has been successfully fractured. In some embodiments, the pressure of the fracturing fluid at the discharge of the one or more pumps 18 may be maintained at 80% or greater of the desired fracturing pressure. In some embodiments, the pressure of the fracturing fluid at the discharge of the one or more pumps 18 may be maintained at 50% or greater of the desired fracturing pressure. Alternatively, the pressure of the fracturing fluid at the discharge of the one or more pumps 18 may be maintained at 25% or greater of the desired fracturing pressure.

Once the isolation valve 150 associated with intermediate zone 5B is closed, the perforation charges 102 associated with intermediate zone 5B may be detonated from the surface in a manner similar to the detonation of the perforation charges 102 associated with the lowermost zone 5C. The intermediate zone 5B may then be fractured to produce intermediate fractures 7B as shown particularly in FIG. 3. The process outlined above for fracturing zones 5B, 5C may again be repeated to hydraulically fracture and thereby form uppermost fractures 7A in the uppermost zone 5A as shown particularly in FIG. 4.

At this point pressure within the central passage 52 of casing string 50 may be vented at the surface 3 to allow the fracturing fluids to flowback into central passage 52 and return to the surface while at least some of the proppant contained within the fracturing zone remains deposited in fractures 7A-7C to ensure each remains propped open. Additionally, the isolation valve 150 of each perforating assembly 100 may be returned to the open configuration or drilled out by coiled-tubing to allow for uninterrupted fluid flow through the central passage 52 of casing string 50. Following flowback of the fracturing fluid, wellbore 30 may be prepared for production by removing at least some of the equipment of surface assembly 12 and replacing it with production equipment (e.g., a Christmas tree connected to a production line, etc.) to thereby configure wellbore 30 for the production of hydrocarbons therefrom. The production phase of wellbore 30 may commence with hydrocarbons flowing into wellbore 30 from the fractures 7A-7C formed by perforating assemblies 100. Perforating assemblies 100 need not be retrieved from the wellbore 30 prior to or during the production phase of wellbore 30, further reducing the time required for completing the hydraulic fracturing operation.

Figure 8:
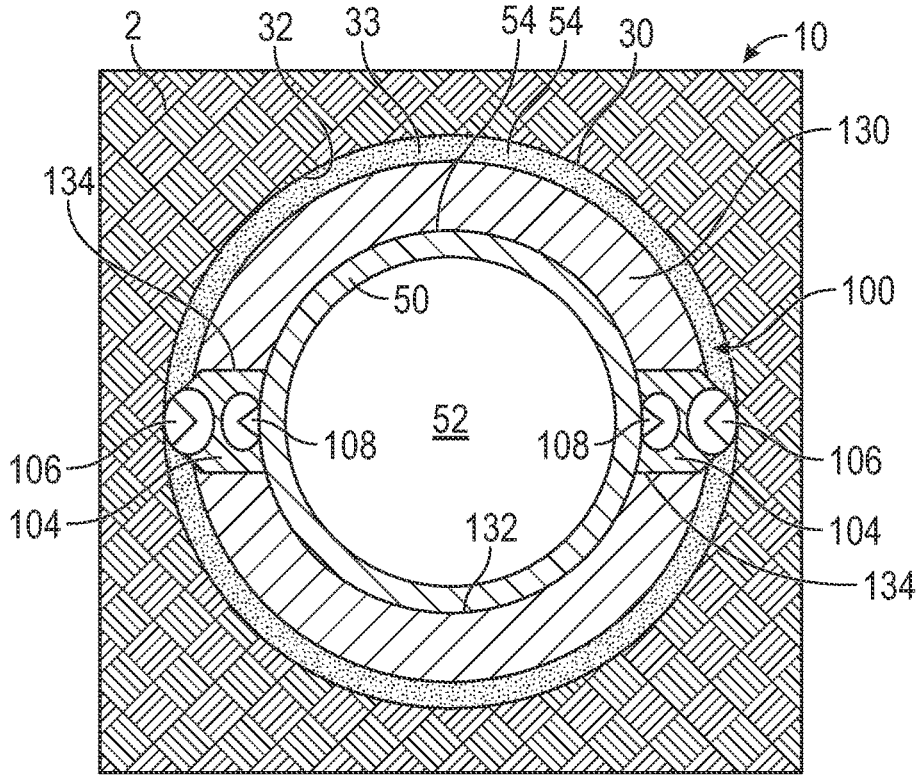
FIGS. 8, 9 are end cross-sectional views of an embodiment of a perforating assembly of the well system of FIGS. 1-4.
Figure 9:
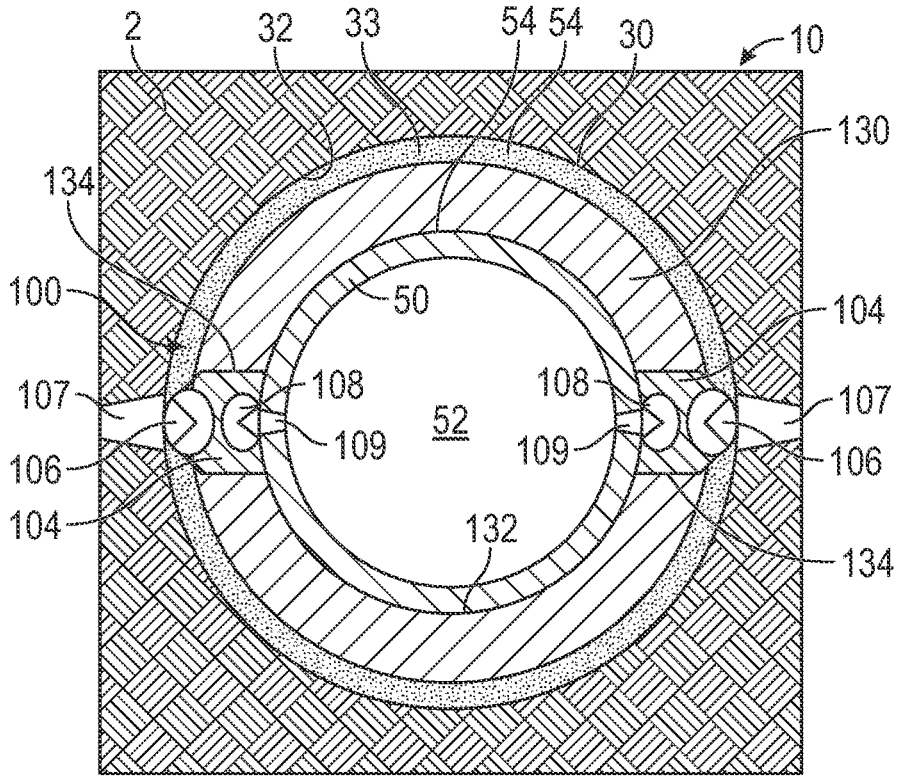
Figure 10:
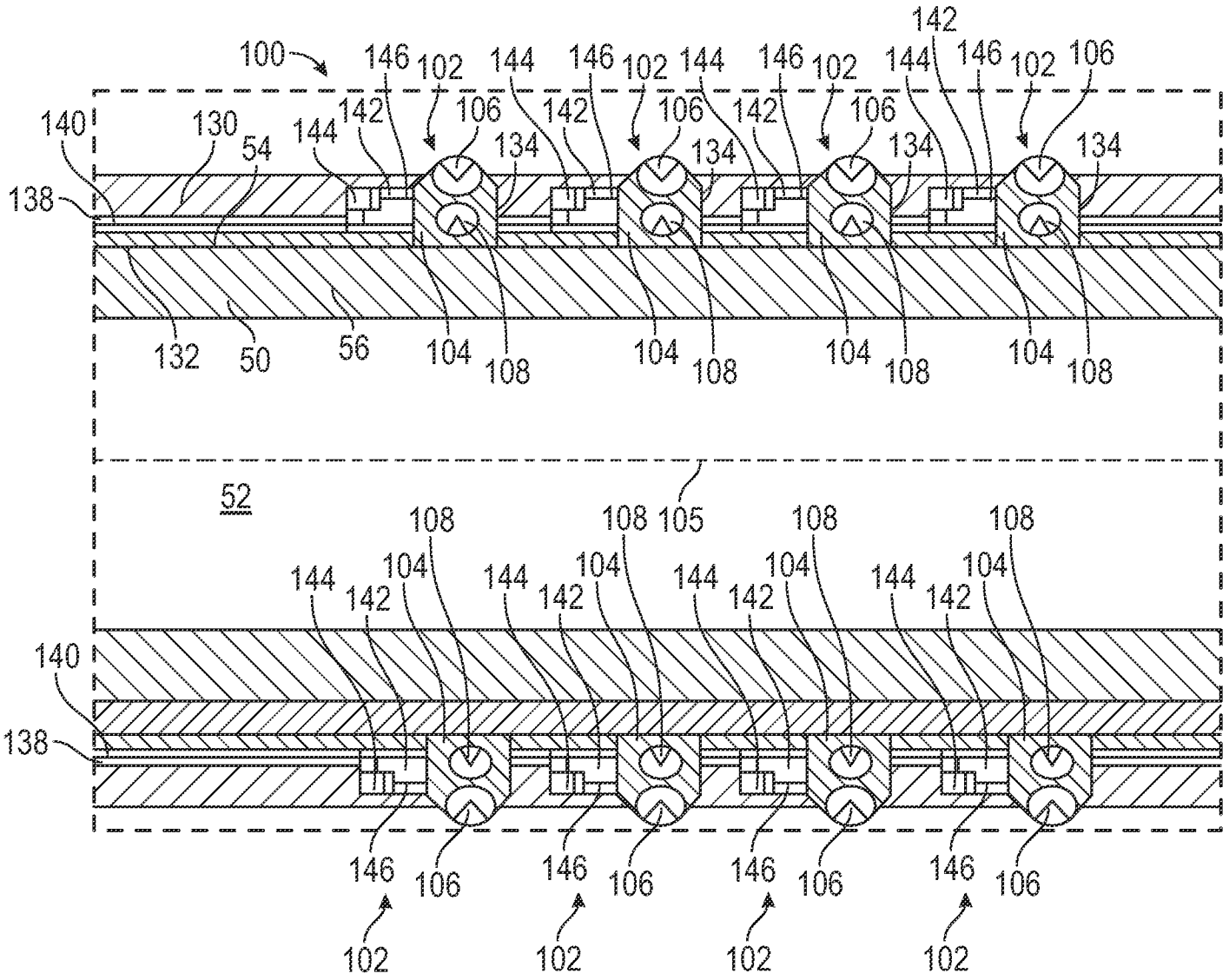
FIG. 10 is a side cross-sectional view of the perforating assembly of FIGS. 8, 9.

Referring to FIGS. 8-10, an embodiment of the perforation charges 102 of a perforating assembly 100 are shown. In this exemplary embodiment, perforation charges 102 are housed within a tubular outer housing or sleeve 130 of the perforating assembly 100 positioned about the outer surface 54 of the casing string 50. Particularly, a generally cylindrical inner surface 132 of the outer sleeve 130 is coupled to the outer surface 54 of casing string 50 whereby relative axial and rotational movement is restricted. In some embodiments, outer sleeve 130 may be threadably connected to a tubular casing joint 56 of casing string 50 of casing string 50. In other embodiments, outer sleeve 130 may be connected to the casing joint 56 via one or more fasteners. In still other embodiments, outer sleeve 130 may be welded to the casing joint 56. Outer sleeve 130 may assist with centralizing casing string 50 within wellbore 30 during the installation thereof.

In this exemplary embodiment, each perforation charge 102 is received in one of a plurality of axially spaced, perforation charge receptacles 134 formed in the outer sleeve 130. Additionally, in this exemplary embodiment, outer sleeve 130 comprises a plurality of circumferentially spaced cable passages 138 extending from an upper end of outer sleeve 130 to a lower end of outer sleeve 130. Each cable passage 138 receives a signal conductor or electrical cable 140 extending therethrough. In other embodiments, outer sleeve 130 may only comprise a single cable passage 138 receiving a single electrical cable 140.

In this exemplary embodiment, outer sleeve 130 comprises a plurality of initiator receptacles 142 each located adjacent a corresponding perforation charge receptacle 134. Each initiator receptacle 142 receives an electrical initiator 144 which is associated with one of the perforation charges 102 of the given perforating assembly 100. Particularly, in this exemplary embodiment, each initiator 144 comprises an electrical switch assembly in signal communication with one of the electrical cables 140. For example, the switch assembly of each initiator 144 may be wired to one of the electrical cables 140. The electrical cable 140 may connect with the electrical cable 23 of communication system 22 and with the electrical cables 140 of other perforating assemblies 100 of well system 10 via one or more electrical interfaces or connectors coupled therebetween.

Figure 11:
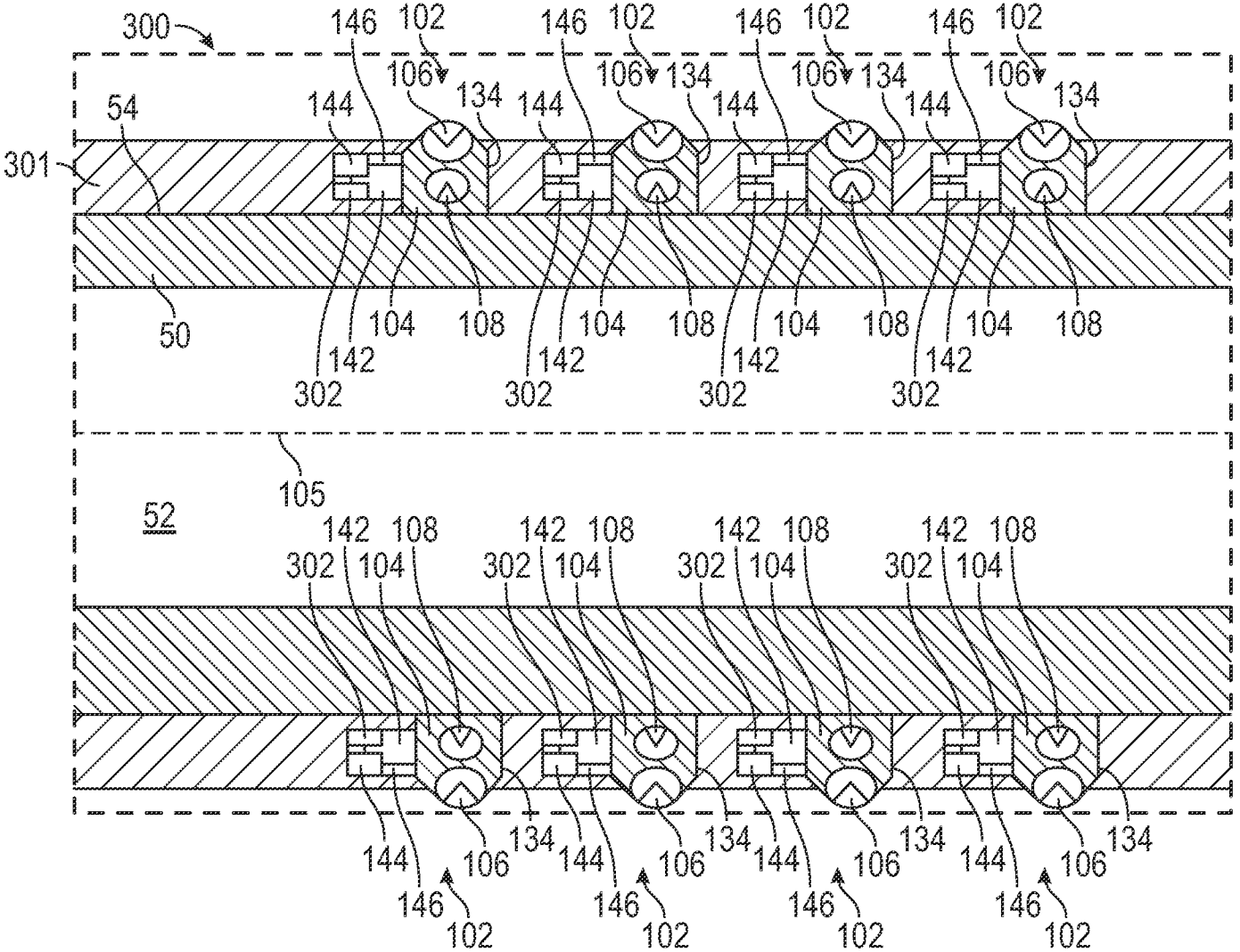
FIG. 11 a side cross-sectional view of another embodiment of a perforating assembly.

In other embodiments, each initiator 144 may communicate wirelessly with the control system 24 via communication system 22. For example, referring briefly to FIG. 11, another embodiment of a perforating assembly 300 is shown which includes an outer housing or sleeve 301 and a plurality of wireless receivers 302 each received in an initiator receptacle 142 and connected to a corresponding initiator 144. Each wireless receiver 302 is configured to receive wireless signals (e.g., acoustic signals, electromagnetic signals, pressure pulse signals, etc.) transmitted from the communication system 22 of surface assembly 12.

Referring again to FIGS. 8-10, in some embodiments, the electrical switch assembly of at least one initiator 144 may comprise a digital switch assembly including a processor and a memory device storing an identifier (e.g., a digital code) uniquely identifying the particular initiator 144. In this manner, the initiator 144 of a given perforating assembly 100 may be addressed individually by the control system 24 of surface assembly 12. In other embodiments, the configuration of the electrical switch assembly of each initiator 144 may vary. For example, in other embodiments, the electrical switch assembly of the initiator 144 may comprise a diode-based switch assembly.

Each initiator 144 of the perforating assembly 100 additionally includes a detonator electrically connected to the electrical switch assembly thereof. The detonator of each initiator 144 comprises an energizable or explosive material which may be selectably detonated on command by the electrical switch assembly of the initiator 144. The detonator of each initiator 144 is ballistically coupled to a detonating or "det" cord 146 extending between the detonator and the perforation charge 102 associated with the given initiator 144. In this configuration, each det cord 146 is ballistically coupled to both the detonator of a given initiator 144 and the perforation charge 102 associated with the given initiator 144 such that the perforation charge 102 may be selectably detonated on command by the electrical switch assembly of the initiator 144. Thus, in this exemplary embodiment, the control system 24 of surface assembly 12 may selectably detonate one or more of the perforation charges 102 of a given perforating assembly by transmitting a signal to the initiators 144 of the perforating assembly 100 via the electrical cable 23 and electrical cables 140 of the perforating assembly 100.

In some embodiments, the perforating assembly 100 may include only a single initiator 144 which is ballistically coupled to each perforation charge 102 of the perforating assembly 100 by a single det cord 146 that is ballistically coupled to the single initiator 144 and each of the plurality of perforation charges 102 comprising the given perforating assembly 100. In this manner, each perforation charge 102 of a given perforating assembly 100 may be detonated concurrently in response to the single initiator 144 receiving a detonation signal addressed to the initiator 144.

In this exemplary embodiment, each perforation charge 102 generally includes a housing 104, a first or radially outer explosive assembly 106, and a second or radially inner explosive assembly 108. The radially outer explosive assembly 106 is oriented in a direction radially away from a central axis 105 of the perforating assembly 100 while the radially inner explosive assembly 108 is oriented in a direction radially towards the central axis 105. As shown particularly in FIG. 9, the radially outer explosive assembly 106 is configured to emit a jet 107 of materials in a radially outwards direction extending through the cement 33 and into the earthen formation 2. Conversely, the radially inner explosive assembly 108 is configured to emit a jet 109 of materials in a radially inwards direction extending entirely through the casing string 50 and into the central passage 52 thereof. The detonation of assemblies 106, 108 also results in the formation of a flowpath extending radially through the perforation charge receptacle 134 in which the perforation charge 102 is received whereby fluid communication is provided through the perforation charge receptacle 134. By penetrating both the cement 33 and casing string 50, perforation charges 102 are configured to establish a flowpath between the central passage 52 of casing string 50 and the earthen formation 2 following their detonation.

Figure 12:
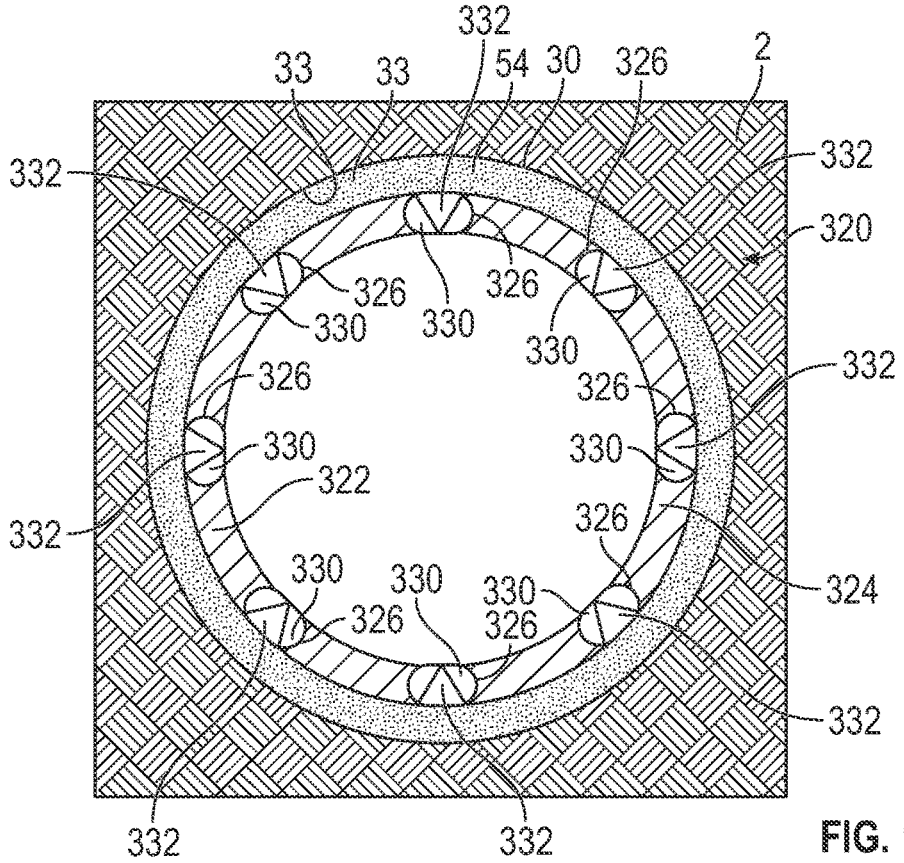
FIGS. 12, 13 are end cross-sectional views of another embodiment of a perforating assembly.
Figure 13:
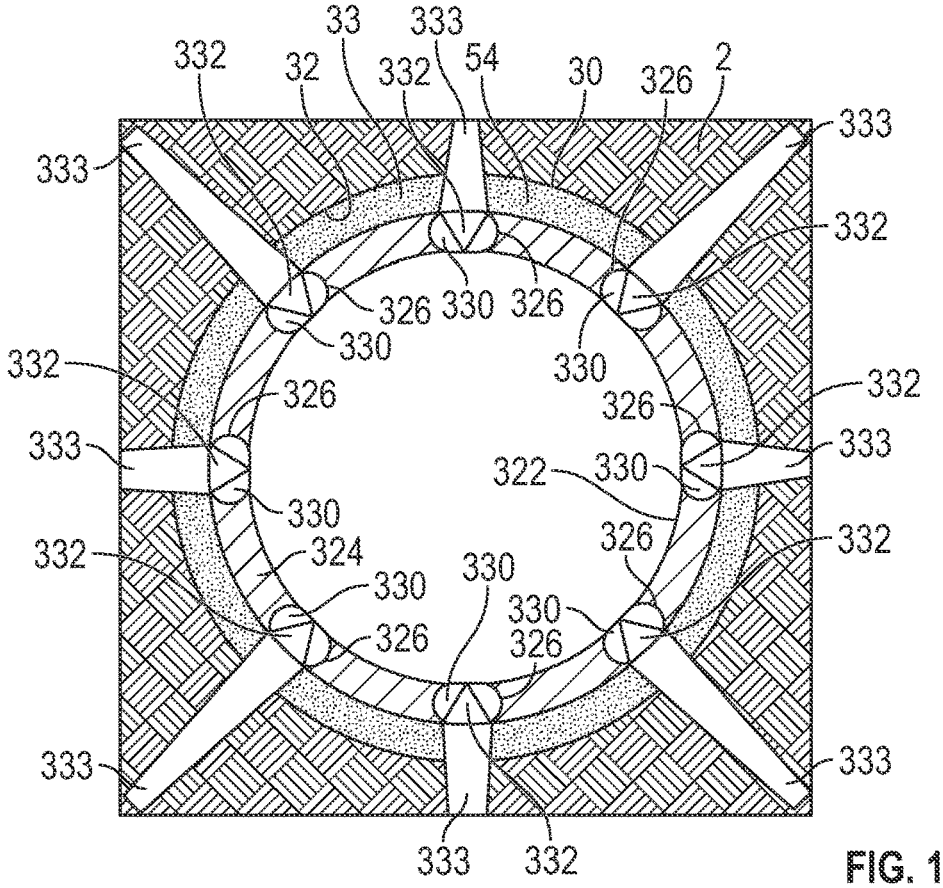

While in this exemplary embodiment perforation charges 102 are positioned external of casing string 50 (casing string 50 being located radially between central axis 105 and the circumferentially spaced perforation charges 102), in other embodiments, perforation charges 102 may be incorporated directly into casing string 102. For example, referring briefly to FIGS. 12, 13, an embodiment of a perforating assembly 320 is shown comprising a casing joint 322 of a casing string 324 installed within wellbore 30 and in which a plurality of circumferentially spaced perforation charges 330 are incorporated. Particularly, in this exemplary embodiment, casing joint 322 comprises a plurality of circumferentially spaced perforation charge receptacles 326. Each perforation charge receptacle extends entirely between a cylindrical inner surface and a cylindrical outer surface of casing joint 322 and receives a corresponding perforation charge 330 such that the perforation charge 330 is housed internally within the casing joint 322.

Each perforation charge 330 of perforating assembly 20 may be in signal communication with the communication system 22 of surface assembly 12 via a wired or wireless connection formed therebetween. In this exemplary embodiment, each perforation charge 330 comprises a single explosive assembly 332 (rather than the two assemblies 106, 108 of the perforation charges 102 described above) configured to emit a jet 333 of materials in a radially outwards direction extending through the cement 33 and into the earthen formation 2, as shown particularly in FIG. 13. The detonation of explosive assembly 332 also results in the formation of a flowpath extending radially through the perforation charge receptacle 134 in which the perforation charge 102 is received whereby fluid communication is provided through the perforation charge receptacle 134.

Figure 14:
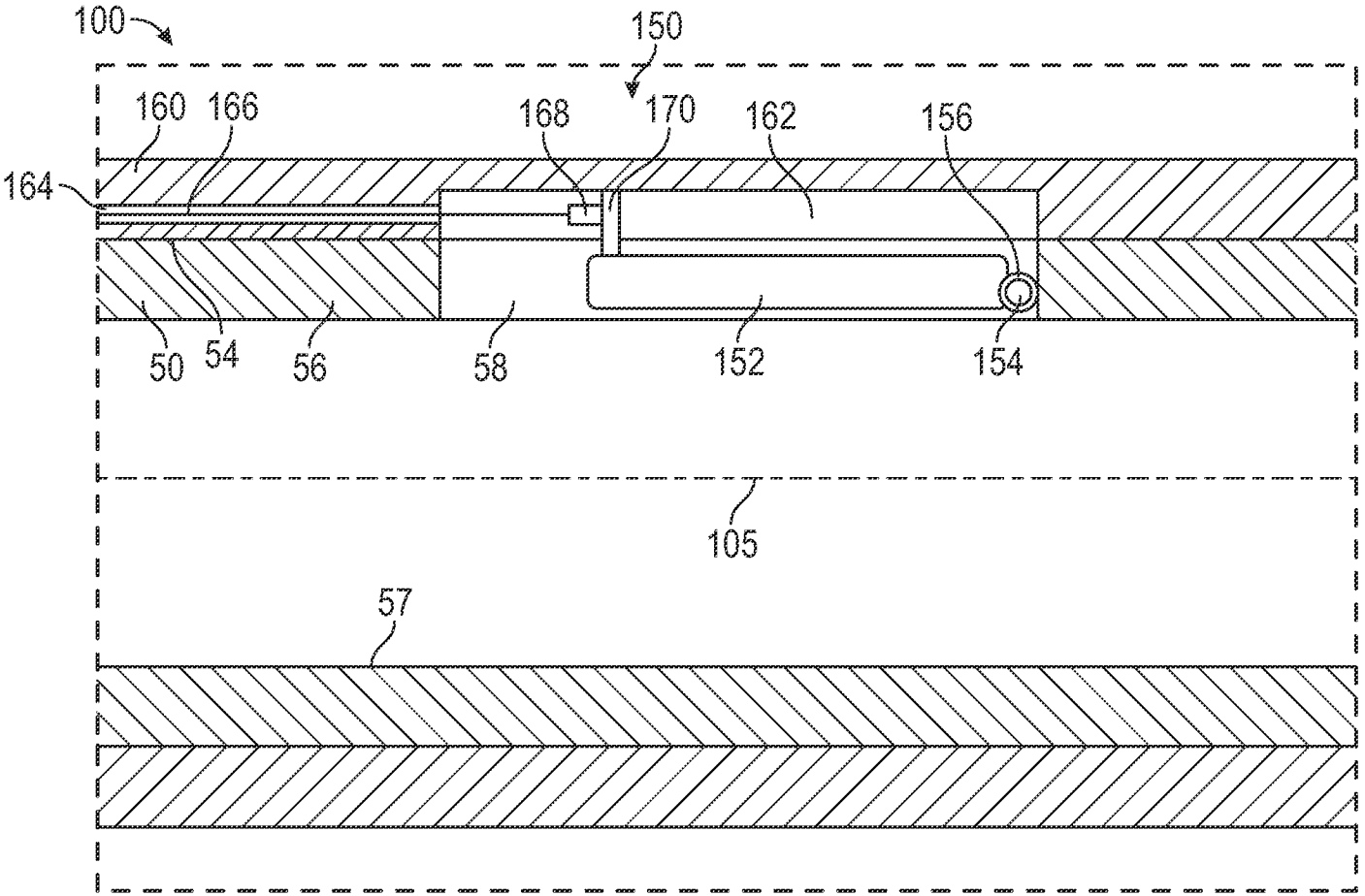
FIG. 14, 15 are side cross-sectional views of an embodiment of an isolation valve of the perforating assembly of FIGS. 8, 9.
Figure 15:
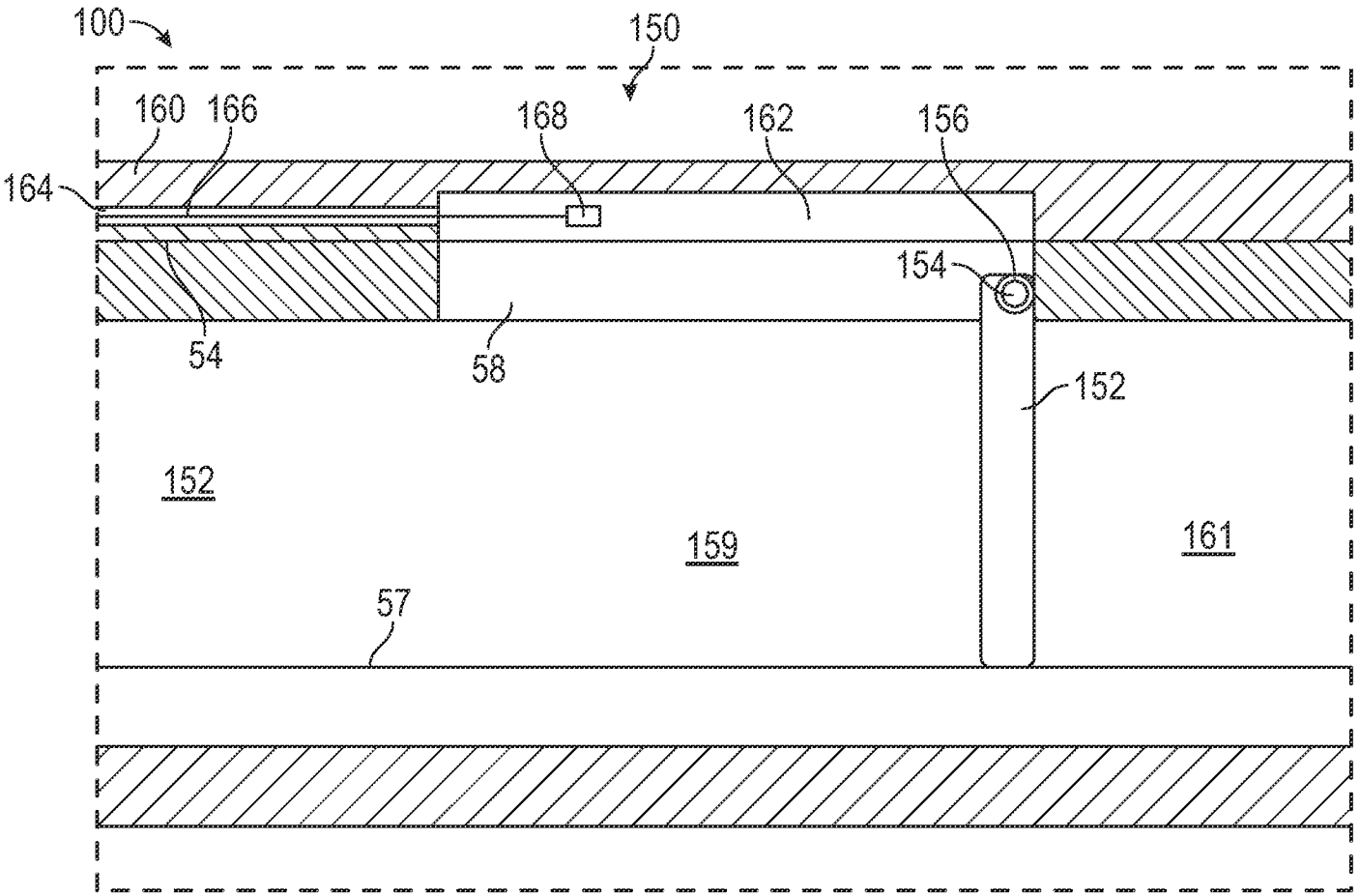

Referring to FIGS. 14, 15, an embodiment of the isolation valve 150 of a perforating assembly 100 are shown. In this exemplary embodiment, the isolation valve 150 comprises a sealing device 152 coupled to a casing joint 56 of the casing string 50. Particularly, the casing joint 56 comprises a valve receptacle 58 formed therein in which the sealing device 152 of the isolation valve 150 is received. Sealing device 152 is coupled to the casing joint 56 by a pivot joint 154. In this configuration, sealing device 152 is configured to rotate about a rotational axis (extending orthogonal central axis 105) extending through the pivot joint 154 between an open position (shown in FIG. 14) and a closed position (shown in FIG. 15) spaced from and disposed at a non-zero angle (e.g., ninety degrees) relative to the open position. The open position of sealing device 152 is associated with the isolation valve 150 while the closed position of sealing device 152 is associated with the closed configuration of the isolation valve 150. Sealing device 152 may sealingly contact an inner surface 57 of the casing joint 56 to create a fluid or pressure barrier across the central passage 52 of casing string 50. Thus, in this exemplary embodiment, sealing device 152 is configured to pivot or rotate relative to the casing joint 56 between the open and closed positions. Sealing device 152 may thus also be referred to herein as a flapper 152. In other embodiments, sealing device 152 may not rotate relative to casing joint 56. For example, in other embodiments sealing device 152 may comprise a gate configured to travel in an orthogonal direction relative to central axis 105 between a retracted open position and an extended closed position.

In this exemplary embodiment, the position of sealing device 152 is controlled by a valve actuator 156 coupled to the sealing device 152. Particularly, valve actuator 156 is configured to selectably rotate sealing device 152 about the rotational axis. Valve actuator 156 may comprise an electrical actuator; however, in other embodiments, the configuration of valve actuator 156 may vary. Additionally, in this exemplary embodiment, an outer housing or sleeve 160 of the isolation valve 150 is positioned about the casing joint 56. Outer sleeve 160 may be coupled to the casing joint 56 in a manner similar to the mechanisms for coupling outer sleeve 130 to casing string 50 described above. Outer sleeve 160 comprises a receptacle 162 aligned with the valve receptacle 58 of the casing joint 56. In this exemplary embodiment, outer sleeve 160 additionally includes a cable passages 164 extending from an upper end of outer sleeve 160 to the receptacle 162. Cable passage 164 receives a signal conductor or electrical cable 166 extending therethrough which is in signal communication with the communication system 22 of surface assembly 12 via the electrical cable 23.

In this exemplary embodiment, a valve initiator 168 and a valve release assembly 170 are located in the receptacle 162 of outer sleeve 160. Valve release assembly 170 is configured to maintain or lock sealing device 152 in the open position until a detonation or detonation signal specifically addressed an electrical switch assembly of valve initiator 168 is received by initiator 168. In this exemplary embodiment, electrical cable 166 is connected to the valve initiator 168, thereby providing signal communication between communication system 22 and valve initiator 166. In other embodiments, valve initiator 166 may be in wireless signal communication with communication system 22 via a wireless receiver similar to the wireless receiver 302 shown in FIG. 11. In this exemplary embodiment, upon sending a uniquely addressed electronic detonation signal from surface and receiving the detonation signal by a targeted specific valve assembly, (e.g., the electronic signal is received by all valves assemblies, however only the targeted valve assembly containing the unique electrical address identifier stored in the memory of the electrical switch assembly responds), the electrical switch assembly of targeted valve initiator 168 may detonate a detonator thereof to thereby release the valve release assembly 170 whereby a biasing mechanism 156 of pivot joint 154 may force the sealing device 152 to actuate from the open position to the closed position, as shown in FIG. 15.

In the closed position, sealing device 152 divides an uphole portion 59 of the central passage 52 of casing string 50 extending uphole from the closed sealing device 152 from a downhole portion 61 of central passage 52 extending downhole from the closed sealing device 152. In this exemplary embodiment, sealing device 152 prevents fluid flow from the uphole portion 59 of central passage 52 to the downhole portion 61 of central passage 52 (allowing for the building of fracturing pressure in the uphole portion 59) while permitting fluid flow from the downhole portion 61 to the uphole portion 59 (permitting the subsequent flowback of the fracturing fluids). Thus, in this exemplary embodiment, isolation valve 150 comprises a one-way valve configured to prevent downhole fluid flow while permitting uphole fluid flow once the sealing device of the isolation valve 150 has been released from the valve release assembly 170. However, in other embodiments, isolation valve 150 may comprise a two-way valve configured to prevent fluid flow in both the uphole and downhole directions when in the closed configuration. In embodiments utilizing two-way isolation valves 150 the sealing device 152 of each isolation valve 150 may dissolve or be drilled out by a coiled-tubing deployed drill in order to allow fluids to flowback to the surface 3.

Figure 16:
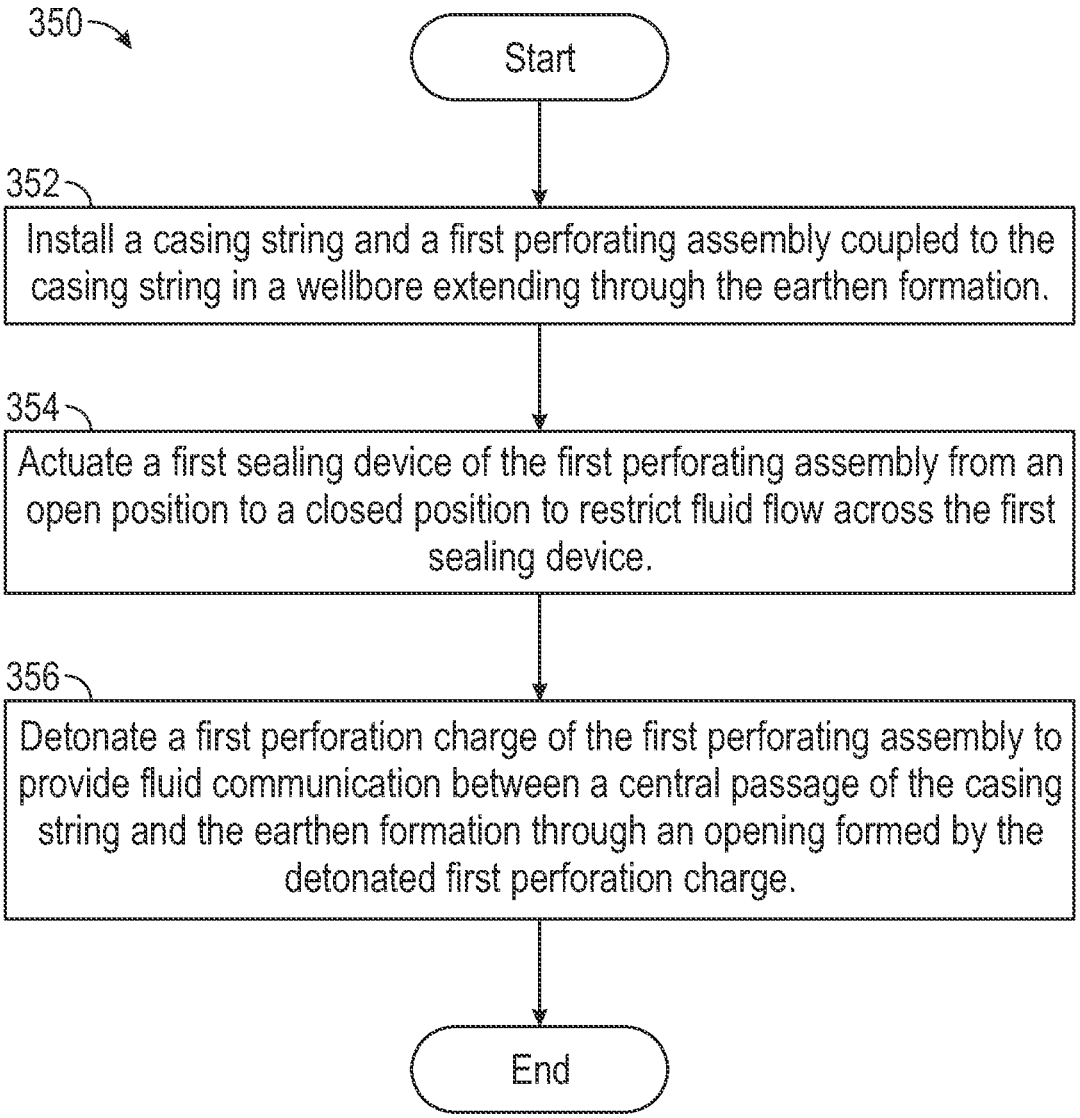
FIGS. 16, 17 are flowcharts illustrating embodiments of methods for completing a wellbore extending through a subterranean earthen formation.

Referring to FIG. 16, an embodiment of a method 350 for completing a wellbore extending through a subterranean earthen formation is shown. Beginning at block 352, method 350 comprises installing a casing string and a first perforating assembly coupled to the casing string in a wellbore extending through the earthen formation. In some embodiments, block 352 comprises installing the casing string 50 and the perforating assemblies 100 coupled thereto in the wellbore 30 shown in FIGS. 1-4. At block 354, method 350 comprises actuating a first sealing device of the first perforating assembly from an open position to a closed position to restrict fluid flow across the first sealing device. In some embodiments, block 354 comprises actuating the sealing device 152 of an isolation valve 150 from the open position shown in FIG. 14 to the closed position shown in FIG. 15. At block 356, method 350 comprises detonating a first perforation charge of the first perforating assembly to provide fluid communication between a central passage of the casing string and the earthen formation through an opening formed by the detonated first perforation charge. In certain embodiments, block 356 comprises detonating one or more of the perforation charges 102 of one of the perforating assemblies 100 shown in FIGS. 1-4. In another embodiment, block 356 comprises detonating one or more of the perforation charges 330 shown in FIGS. 12, 13.

Figure 17:
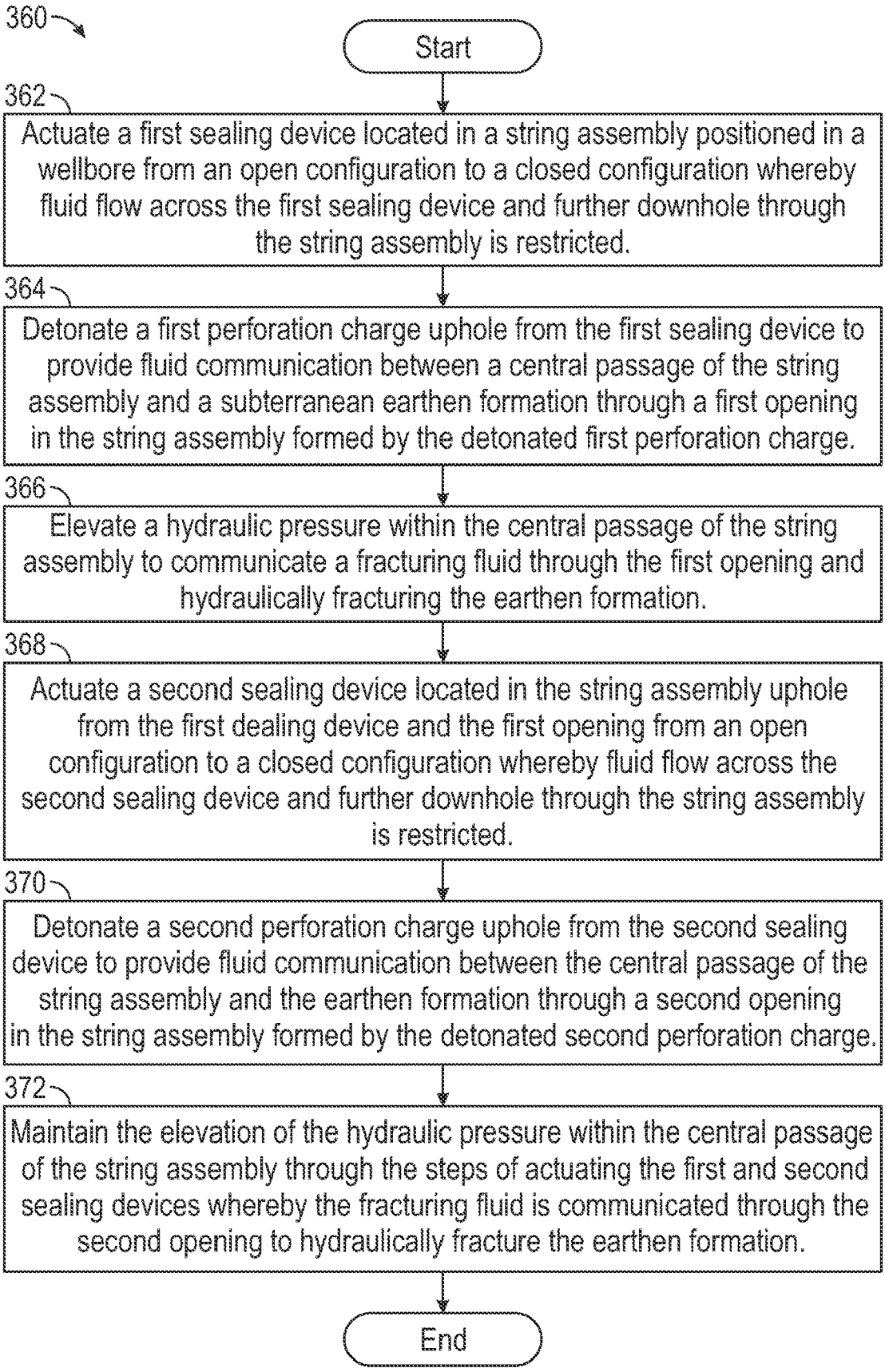

Referring to FIG. 17, another embodiment of a method 360 for completing a wellbore extending through a subterranean earthen formation is shown. Beginning at block 362, method 360 comprises actuating a first sealing device located in a string assembly positioned in the wellbore from an open configuration to a closed configuration whereby fluid flow across the first sealing device and further downhole through the string assembly is restricted. In some embodiments, block 362 comprises actuating the sealing device 152 of an isolation valve 150 from the open position shown in FIG. 14 to the closed position shown in FIG. 15. For example, block 362 may comprise actuating the isolation valve 150 of the perforating assembly 100 associated with lowermost production zone 5C from the open configuration to the closed configuration whereby fluid flow across the isolation valve 150 and further downhole through casing string 50 is restricted.

In some embodiments, block 362 comprises confirming that sealing device 152 is fully closed and has sealed the portion of casing string 50 extending uphole from the sealing device 152 from the portion of casing string 50 extending downhole from member 152. For example, prior to actuating the sealing device 152 of isolation valve 150 into the closed position, the fracturing fluid pressure at the discharge of surface pump system 16 may be bled down to a pressure less than the desired fracturing pressure. For instance, the pressure at the discharge of surface pump system 16 may be bled down to approximately between 50% and 80% of the desired fracturing pressure in some embodiments. The surface pump system 16 may then be subsequently activated until the desired fracturing pressure is achieved at the discharge of surface pump system 16. The amount of time required to restore the desired fracturing pressure at the discharge of surface pump system 16 may be monitored by personnel of well system 10 to determine if the sealing device 152 of isolation valve 150 has successfully sealed the casing string 50. Particularly, a relatively rapid increase in pressure following the activation of surface pump system 16 may indicate a successful seal by sealing device 152 while a sluggish increase in pressure may indicate that fluid within casing string 50 is leaking past sealing device 152.

At block 364, method 360 comprises detonating a first perforation charge uphole from the first sealing device to provide fluid communication between a central passage of the string assembly and a subterranean earthen formation through a first opening in the string assembly formed by the detonated first perforation charge. In some embodiments, block 364 comprises detonating one or more of the perforation charges 102 of one of the perforating assemblies 100 shown in FIGS. 1-4. In another embodiment, block 364 comprises detonating one or more of the perforation charges 330 shown in FIGS. 12, 13. For example, block 364 may comprise detonating one or more of the peroration charges 102 of the perorating assembly 100 associated with lowermost production zone 5C to provide fluid communication between the central passage 52 of casing string 50 and the lowermost production zone 5C of earthen formation 2 through openings formed in the casing string 50 by the detonation of the one or more perforation charges 102.

At block 366, method 360 comprises elevating a hydraulic pressure within the central passage of the string assembly to communicate a fracturing fluid through the first opening and hydraulically fracturing the earthen formation. In some embodiments, block 366 comprises elevating a hydraulic pressure within the central passage 52 of casing string 50 to communicate a fracturing fluid through openings formed by the detonation of the one or more perforation charges 102 of the perforating assembly 100 associated with lowermost production zone 5C and to thereby hydraulically fracture the lowermost production zone 5C of earthen formation 2.

At block 368, method 360 comprises actuating a second sealing device located in the string assembly uphole from the first dealing device and the first opening from an open configuration to a closed configuration whereby fluid flow across the second sealing device and further downhole through the string assembly is restricted. In some embodiments, block 368 actuating the isolation valve 150 of the perforating assembly 100 associated with intermediate production zone 5B from the open configuration to the closed configuration whereby fluid flow across the isolation valve 150 and further downhole through casing string 50 is restricted. The actuation of the isolation valve 150 may thereby restrict fluid communication between the central passage 52 of casing string 50 and the openings formed by the detonation of the one or more perforation charges 102 of the perforating assembly 100 associated with lowermost production zone 5C.

At block 370, method 360 comprises detonating a second perforation charge uphole from the second sealing device to provide fluid communication between the central passage of the string assembly and the earthen formation through a second opening in the string assembly formed by the detonated second perforation charge. In some embodiments, block 370 comprises detonating one or more of the perforation charges 102 of the perorating assembly 100 associated with intermediate production zone 5B to provide fluid communication between the central passage 52 of casing string 50 and the intermediate production zone 5B of earthen formation 2 through openings formed in the casing string 50 by the detonation of the one or more perforation charges 102.

At block 372, method 360 comprises activating maintaining the elevation of the hydraulic pressure within the central passage of the string assembly through the steps of actuating the first and second sealing devices whereby the fracturing fluid is communicated through the second opening to hydraulically fracture the earthen formation. In some embodiments, block 372 comprises maintaining the elevation of the hydraulic pressure within the central passage 52 of casing string 50 through the steps of actuating the isolation valves 150 of the perforating assemblies associated with production zones 5B and 5C into the closed configuration. For example, block 372 may comprise maintaining a surface pressure of the hydraulic fracturing fluid supplied by surface pump system 16 above atmospheric pressure through the steps of actuating the isolation valves 150 of the perforating assemblies associated with production zones 5B and 5C into the closed configuration. In other words, the surface pressure of the fracturing fluid may not be permitted to reach atmospheric conditions (e.g., be vented to the atmosphere) between the actuation of the isolation valve 150 associated with the lowermost production zone 5C and the actuation of the isolation valve 150 associated with the intermediate production zone 5B. In some embodiments, block 372 comprises maintaining a surface pressure of the fracturing fluid at a pressure that is at least 50% of the surface pressure of the fracturing fluid utilized to hydraulically fracture the earthen formation. For example, the surface pressure of the fracturing fluid (e.g., the discharge pressure of the fracturing fluid at surface pump system 16) may be maintained to at least 50% of the surface pressure of the fracturing fluid provided to the central passage 52 of casing string 50 during the hydraulic fracturing (e.g., the formation of fractures 7B, 7C) of at least one of the production zones 5B, 5C of the earthen formation 2.

In certain embodiments, method 360 includes activating the one or more surfaces pumps 18 of surface pump assembly 16 to increase fluid pressure within the central passage 52 of casing string 50 prior to the detonation of the perforation charges 102 of at least one of the perforating assemblies 100 shown in FIGS. 1-4 such that the desired fracturing pressure is achieved at the discharge of surface pump system 16. In other embodiments, the pressure at the discharge of surface pump system 16 may be varied before, during, and/or after the detonation of the one or more perforation charges 104. For example, the pressure at the discharge of the surface pump system 16 may exceed the desired fracturing pressure before, during, and/or after the detonation of the one or more perforation charges 104. Conversely, the pressure at the discharge of the surface pump system 16 may be less than the desired fracturing pressure before, during, and/or after the detonation of the one or more perforation charges 104

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A system for completing a wellbore extending through a subterranean earthen formation, the system comprising:

a casing string positioned in a wellbore extending through a subterranean earthen formation; and a first perforating assembly coupled to the casing string, wherein the first perforating assembly comprises:

a first perforation charge coupled to the casing string, wherein the perforation charge comprises an explosive material configured to blast towards the earthen formation upon detonation of the first perforation charge; and a first sealing device coupled to the casing string, wherein the first sealing device comprises an open configuration configured to permit fluid flow across the first sealing device and a closed configuration configured to restrict fluid flow across the first sealing device when in the closed configuration;

wherein the first perforating assembly is configured to at least one of detonate the first perforation charge and actuate the first sealing device into the closed configuration in response to receiving a first signal individually addressed to the first perforating assembly.

2. The system of claim 1, wherein the first perforation charge is positioned radially between the casing string and a sidewall of the wellbore.

3. The system of claim 2, wherein the first perforation charge comprises a first explosive assembly configured to eject the stream of material towards the earthen formation, and a second explosive assembly configured to blast in an opposed direction towards the casing string.

4. The system of claim 2, wherein the first perforating assembly comprises an outer sleeve coupled to an outer surface of the casing string and comprising a receptacle which receives the first perforation charge.

5. The system of claim 1, further comprising:

a surface communication system in signal communication with the first perforating assembly;

wherein the first perforating assembly comprises a perforation charge initiator coupled to the casing string, wherein the perforation charge initiator is configured to detonate the first perforation charge in response to receiving a detonation signal transmitted by the surface communication system.

6. The system of claim 5, further comprising a control system a control system in signal communication with the perforation charge initiator; wherein the control system is configured to transmit an identifier with the detonation signal that uniquely identifies the perforation charge initiator.

7. The system of claim 1, wherein the first perforating assembly comprises a first isolation valve comprising the first sealing device, and wherein the first isolation valve comprises a valve initiator and a valve release assembly configured to maintain the first sealing device in the open configuration and to permit the first sealing device to actuate into the closed configuration in response to a detonation of the valve initiator.

8. The system of claim 1, wherein the first perforation charge is received within an aperture formed in the casing string.

9. The system of claim 1, further comprising a second perforating assembly coupled to the casing string and spaced from the first perforating assembly along the casing string, wherein the second perforating assembly comprises:

a second perforation charge coupled to the casing string, wherein the perforation charge comprises an explosive material configured to blast towards the earthen formation upon detonation of the second perforation charge; and a second sealing device coupled to the casing string, wherein the second sealing device comprises a closed configuration configured to restrict fluid flow across the second sealing device when in the closed configuration.

10. The system of claim 9, wherein the first perforating assembly is associated with a first production zone of the earthen formation and the second perforating assembly is associated with a separate, second production zone of the earthen formation.

11. The system of claim 1, wherein the casing string is secured to a sidewall of the wellbore by cement located in annulus formed between the casing string and the sidewall of the wellbore.

12. The system of claim 1, further comprising a second perforating assembly coupled to the casing string, wherein the second perforating assembly comprises:

a second perforation charge coupled to the casing string, wherein the perforation charge comprises an explosive material configured to blast towards the earthen formation upon detonation of the second perforation charge; and a second sealing device coupled to the casing string, wherein the second sealing device comprises an open configuration configured to permit fluid flow across the second sealing device and a closed configuration configured to restrict fluid flow across the second sealing device when in the closed configuration;

wherein the second perforating assembly is configured to at least one of detonate the second perforation charge and actuate the second sealing device into the closed configuration in response to receiving a second signal individually addressed to the second perforating assembly.

13. A method for completing a wellbore extending through a subterranean earthen formation, the method comprising:

(a) actuating a first sealing device located in a string assembly positioned in the wellbore from an open configuration to a closed configuration whereby fluid flow across the first sealing device and further downhole through the string assembly is restricted;

(b) detonating a first perforation charge uphole from the first sealing device to provide fluid communication between a central passage of the string assembly and the earthen formation through a first opening in the string assembly formed by the detonated first perforation charge;

(c) elevating a hydraulic pressure within the central passage of the string assembly to communicate a fracturing fluid through the first opening and hydraulically fracturing the earthen formation;

(d) actuating a second sealing device located in the string assembly uphole from the first dealing device and the first opening from an open configuration to a closed configuration whereby fluid flow across the second sealing device and further downhole through the string assembly is restricted; and (e) detonating a second perforation charge uphole from the second sealing device to provide fluid communication between the central passage of the string assembly and the earthen formation through a second opening in the string assembly formed by the detonated second perforation charge; and (f) maintaining the elevation of the hydraulic pressure within the central passage of the string assembly through steps (a) through (e) whereby the fracturing fluid is communicated through the second opening to hydraulically fracture the earthen formation.

14. The method of claim 13, further comprising:

(g) activating a surface pump to increase the hydraulic pressure within the central passage of the string assembly prior to the detonation of the first perforation charge.

15. The method of claim 13, wherein (a) comprises detonating a valve initiator to release a release assembly coupled to the first sealing device and thereby permit the sealing device to actuate into the closed position.

16. The method of claim 13, wherein (b) comprises transmitting a detonation signal from a surface communication system to a perforation charge initiator coupled to the string assembly whereby the perforation charge initiator detonates the first perforation charge in response to receiving the detonation signal.

17. The method of claim 13, wherein (f) comprises maintaining a surface pressure of the fracturing fluid at a pressure that is at least 50% of a surface pressure of the fracturing fluid utilized to hydraulically fracture the earthen formation at (c).

18. A system for completing a wellbore extending through a subterranean earthen formation, the system comprising:

a casing string positioned in a wellbore extending through a subterranean earthen formation;

a first perforating assembly coupled to the casing string, wherein the first perforating assembly comprises:

a first perforation charge coupled to the casing string, wherein the perforation charge comprises an explosive material configured to blast towards the earthen formation upon detonation of the first perforation charge; and a first seating device coupled to the casing string, wherein the first sealing device comprises an open configuration configured to permit fluid flow across the first sealing device and a closed configuration configured to restrict fluid flow across the first sealing device when in the closed configuration;

a second perforating assembly coupled to the casing string, wherein the second perforating assembly comprises:

a second perforation charge coupled to the casing string, wherein the second perforation charge comprises an explosive material configured to blast towards the earthen formation upon detonation of the second perforation charge; and a second sealing device coupled to the casing string, wherein the second sealing device comprises an open configuration configured to permit fluid flow across the second sealing device and a closed configuration configured to restrict fluid flow across the second sealing device when in the closed configuration;

a surface pump in fluid communication with the central passage of the string assembly, the surface pump configured to elevate a hydraulic pressure in the central passage and to maintain the elevated hydraulic pressure in the central passage between an actuation of the first sealing device from the open configuration to the closed configuration and the actuation of the actuation of the second sealing device from the open configuration to the closed configuration.

19. A system for completing a wellbore extending through a subterranean earthen formation, the system comprising:

a casing string positioned in a wellbore extending through a subterranean earthen formation;

a first perforating assembly coupled to the casing string, wherein the first perforating assembly comprises:

a first perforation charge coupled to the casing string, wherein the perforation charge comprises an explosive material configured to blast towards the earthen formation upon detonation of the first perforation charge; and a first seating device coupled to the casing string, wherein the first sealing device comprises an open configuration configured to permit fluid flow across the first sealing device and a closed configuration configured to restrict fluid flow across the first sealing device when in the closed configuration;

a communication system comprising a surface signal transmitter and a signal receiver coupled to the casing string and configured to detonate the first perforation charge in response to receiving a first signal from the surface signal transmitter and to actuate the first sealing device from the open configuration to the closed configuration in response to receiving a second signal from the surface signal transmitter.

20. A system for completing a wellbore extending through a subterranean earthen formation, the system comprising:

a casing string positioned in a wellbore extending through a subterranean earthen formation;

a first perforating assembly coupled to the casing string, wherein the first perforating assembly comprises:

a first perforation charge coupled to the casing string, wherein the perforation charge comprises an explosive material configured to blast towards the earthen formation upon detonation of the first perforation charge; and a first seating device coupled to the casing string, wherein the first sealing device comprises an open configuration configured to permit fluid flow across the first sealing device and a closed configuration configured to restrict fluid flow across the first sealing device when in the closed configuration;

an initiator assembly coupled to the casing string and configured to at least one of actuate the first sealing device from the open configuration to the closed configuration in response to a detonation of the initiator assembly and to detonate the first perforation charge in response to receiving a detonation signal.

21. The system of claim 20, wherein the initiator assembly comprises:

a valve initiator coupled to the casing string and configured to actuate the first sealing device from the open configuration to the closed configuration in response to a detonation of the valve initiator; and a perforation charge initiator coupled to the casing string and configured to detonate the first perforation charge in response to the initiator assembly receiving the detonation signal.

22. A system for completing a wellbore extending through a subterranean earthen formation, the system comprising:

a casing string positioned in a wellbore extending through a subterranean earthen formation;

a first perforating assembly coupled to the casing string, wherein the first perforating assembly comprises:

a first perforation charge coupled to the casing string, wherein the perforation charge comprises an explosive material configured to blast towards the earthen formation upon detonation of the first perforation charge; and a first seating device coupled to the casing string, wherein the first sealing device comprises an open configuration configured to permit fluid flow across the first sealing device and a closed configuration configured to restrict fluid flow across the first sealing device when in the closed configuration;

a communication system comprising a surface signal transmitter and a signal receiver coupled to the casing string and connected to the surface signal transmitter by a signal link extending external the central passage of the casing string between the surface signal transmitter and the signal receiver.

23. The system of claim 22, wherein the communication system comprises a signal repeater coupled to the casing string and located between the surface signal transmitter and the signal receiver, the signal repeater configured to repeat the signal transmitted by the surface signal transmitter.

* * * * *